US006776703B2

(12) United States Patent
Abe et al.

(10) Patent No.: US 6,776,703 B2
(45) Date of Patent: Aug. 17, 2004

(54) COIN DISPENSING DEVICE WITH ALIGNED HOPPERS

(75) Inventors: Hiroshi Abe, Iwatsuki (JP); Motoharu Kurosawa, Iwatsuki (JP)

(73) Assignee: Asahi Seiko Co., Ltd., Saitama-ken (JP)

( * ) Notice: Subject to any disclaimer, the term of this patent is extended or adjusted under 35 U.S.C. 154(b) by 70 days.

(21) Appl. No.: 10/331,049

(22) Filed: Dec. 27, 2002

(65) Prior Publication Data

US 2003/0148729 A1 Aug. 7, 2003

(30) Foreign Application Priority Data

Dec. 28, 2001 (JP) ..... 2001-400684

(51) Int. Cl.[7] ..... G07D 1/00
(52) U.S. Cl. ..... 453/57; 221/92
(58) Field of Search ..... 453/3, 29, 18, 453/19, 20, 63; 221/92, 93, 94, 95, 124, 130, 131, 133

(56) References Cited

U.S. PATENT DOCUMENTS

| | | | | |
|---|---|---|---|---|
| 4,688,978 | A * | 8/1987 | Ohkuma et al. | 414/224.01 |
| 5,360,369 | A * | 11/1994 | Larsson et al. | 453/19 |
| 5,964,657 | A | 10/1999 | Abe et al. | 453/3 |
| 6,346,039 | B2 | 2/2002 | Orton et al. | 453/3 |
| 6,609,966 | B1 * | 8/2003 | Kurosawa et al. | 453/57 |
| 2001/0010315 | A1 * | 8/2001 | Tomioka | 221/155 |

* cited by examiner

*Primary Examiner*—Donald P. Walsh
*Assistant Examiner*—Mark J. Beauchaine

(57) ABSTRACT

A coin dispensing device provides a housing frame that can be mounted within a predetermined space within a machine that requires dispensing coins in more than one denomination. A plurality of coin hoppers for respectively different denominations of coins can be stacked in vertical alignment within the housing frame for dispensing the coins. A cover member can provide a common passageway connected to the coin hoppers. The coin hoppers can be slid out of the housing frame for servicing and slid back into the housing frame for engagement with a transmission assembly to permit selective driving of a coin hopper dispensing unit from a power source such as a single motor.

20 Claims, 23 Drawing Sheets

COIN DISPENSING DEVICE WITH ALIGNED HOPPERS

BACKGROUND OF THE INVENTION

1. Field of the Invention

This present invention relates to an improvement in a coin dispensing device which can be used in a vending machine, a checkout machine or a change machine and more particularly to a coin dispensing device which dispenses coins of different denominations from a plural of coin hoppers positioned in a compact configuration.

2. Description of Related Art

"Coin" which is used in this specification embodies metals, discs or tokens like a coin. In the known prior art, coins are piled up in parallel tubes of common denomination, and are selectively dispensed from the lower section of the tubes, such as in the Japanese Patent 3137163. Therefore a coin mechanism includes a coin receiving device, a coin distinguishing device, a coin diverter and a coin dispensing device, and the overall size is of a de facto standard for the industry.

In the prior art, the coins are generally inserted in the tubes, one by one, by hand. The present applicant has applied for an application which stores coins in bulk for each denomination and has a storing member (a coin hopper) which dispenses the coins one by one as shown in the Japanese publication of patent application 9-265561.

The coin hopper has a rotating disc which dispenses the coins and uses a motor for rotating the rotating disc. Therefore the coin hopper is limited by the size of the rotating disc. As a result, four standard coin hoppers cannot be mounted in the de facto standard size housing that manufacturers of machines that incorporate coin dispensing devices allocate.

SUMMARY OF THE INVENTION

The purpose of the present invention is to provide a smaller coin dispensing device for a plurality of different denominations. By improving a layout arrangement of the coin hoppers and their coin passageway, the coin dispensing device can incorporate a plurality of coin hoppers. More specifically, a purpose of the present invention is to provide a coin dispensing device which is smaller and can be incorporated in the space provided for in existing vending machines.

Another purpose of the present invention is to provide a coin dispensing device with the ability to meet the de facto standard measurements accepted in the industry.

Still another purpose of the present invention is to reduce the cost of a coin dispensing device.

Another purpose of the present invention is to enable an easy and quick refilling to the coin dispensing device.

The coin dispensing device includes at least two coin hoppers which both have a rotating disc to dispense coins one by one, the coin hoppers being located and aligned in a lateral horizontal direction, a common dispensing passageway which is used by both of the hoppers to guide and dispensed the coins from these hoppers.

In this structure, each denomination can be stored in bulk in a separate coin hopper with a rotating disc and selected denominations are dispensed through the common dispensing passageway one by one.

Two rotating discs of the coin hoppers can be located in parallel and are aligned laterally in a compact space. The dispensed coins are dispensed from the coin hoppers and are guided to the dispensing exit by the common dispensing passageway. As a result, the coin dispensing device becomes smaller and can be attached into existing standard spaces. Also, the refilling of the coins isn't tedious nor time consuming.

The coin dispensing device can further include at least three coin hoppers which have rotating discs which dispense coins one by one. The coin hoppers are positioned both adjacent to each other and in a vertical direction within a housing member, and a dispensing passageway which is common for all the hoppers can guide and dispense the coins from these hoppers.

In this structure, the coins are stored in bulk in the coin hoppers with rotating discs. Selected coins are dispensed from the selected hoppers one by one into the dispensing passageway which is common to each hopper and can form part of a closing member for the housing member.

Therefore the space of the coin hoppers becomes smaller, and the coin dispensing device can be made smaller.

The rotating discs can be slanted and the project areas of the rotating discs are made smaller, because the rotating discs are positioned at a slant.

Therefore the project area of the rotating discs are smaller. Also, the diameter of each rotating disc can be increased. Therefore the through-holes of the rotating disc can be increased, because the diameter of the rotating disc can be increased. As a result, the dispensing of the coins becomes smooth, because the through frequency of coins is increased.

The common dispensing passageway is adjacent to a pair of rotating discs of these coin hoppers which are aligned in the lateral direction and also the coin hopper aligned in the vertical direction.

In this structure, the coins are dispensed by the coin hoppers from the left and right side. Therefore the dispensing condition of the coin hoppers can be arranged in a common manner. The arranging operation becomes easy and the coin dispensing becomes smooth, because the left and right sides of the coin hoppers can be arranged in the same manner. Also, the overall layout becomes smaller, as a result, the coin dispensing device can be located in the de facto standard size for vending machines.

This present invention is desirable because further, it can use a single driving motor assembly which is common to these rotating discs for each coin-hopper, and a transmission assembly which can selectively couple the driving motor and the rotating discs. In this structure, the rotating discs of plural coin hoppers are driven by a transmission from the driving motor. Therefore the coin hoppers become smaller, as they don't require separate driving motors and can further reduce the cost, because there is only one driving motor assembly.

In this structure, clutches can be selectively engaged, and only one rotating disc of a coin hopper is rotated at a time, and the coin hopper dispenses the coins to the dispensing passageway one by one. Therefore the coins don't jam, because the coins can only be let off one by one through a common passageway. The dispensing passageway can become smaller, and accordingly the coin dispensing device can be made smaller. Also, the coins aren't dispensed into the dispensing passageway from the left and right side of the hoppers at the same time. Therefore the coins don't jam.

The rotating disc can have at least coin two holes. In this structure, the coins pass through either of the holes by the rotation of the rotating disc, and afterwards the coins are dispensed. Therefore the coin-dispensing-time is shorter, because the coins pass-through probability is in proportion to the number of holes. As a result, the coins are dispensed quickly.

The individual coin hoppers can be moved out of a supporting house frame on sliding mounting assemblies. Therefore the coins are refilled in the coin hoppers at positions which are out of the frame. As a result, the work of refilling is easy.

A transmission driver structure for each rotating disc is located in the housing frame, and when the coin-hoppers are located in the frame, a driven unit for each of these rotating discs has contact with this driver structure. In this structure, when the coin hopper are returned into the frame, the driven units have contact with the associating drivers, and the driven units can be driven by the driver structure. Therefore additional connecting work between driven units and drivers is unnecessary by a service technician.

The coin-hoppers have a first gear which has a rotating axis parallel to the rotating axis of the driver and a second gear which has a rotating axis which slants the same as the rotating disc, and the second gear is directly or indirectly driven by the first gear. In this structure, the first gear is the driver and the driven unit can be made by a spur gear. Therefore the spur gears can be easily contacted and can reduce the cost.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the coin vending art to make and use the invention and sets forth the best modes contemplated by the inventors of carrying out their invention. Various modifications, however, will remain readily apparent to those skilled in the art, since the general principles of the present invention have been defined herein specifically to provide a compact coin dispensing device with a plurality of hoppers.

The three embodiments of the present invention use Japanese Yen, however, they can use U.S. coins, Euro coins, tokens, medals, medallions, etc. The first embodiment can dispense two denominations which can be either 10 Yen or 100 Yen.

Figure 1:
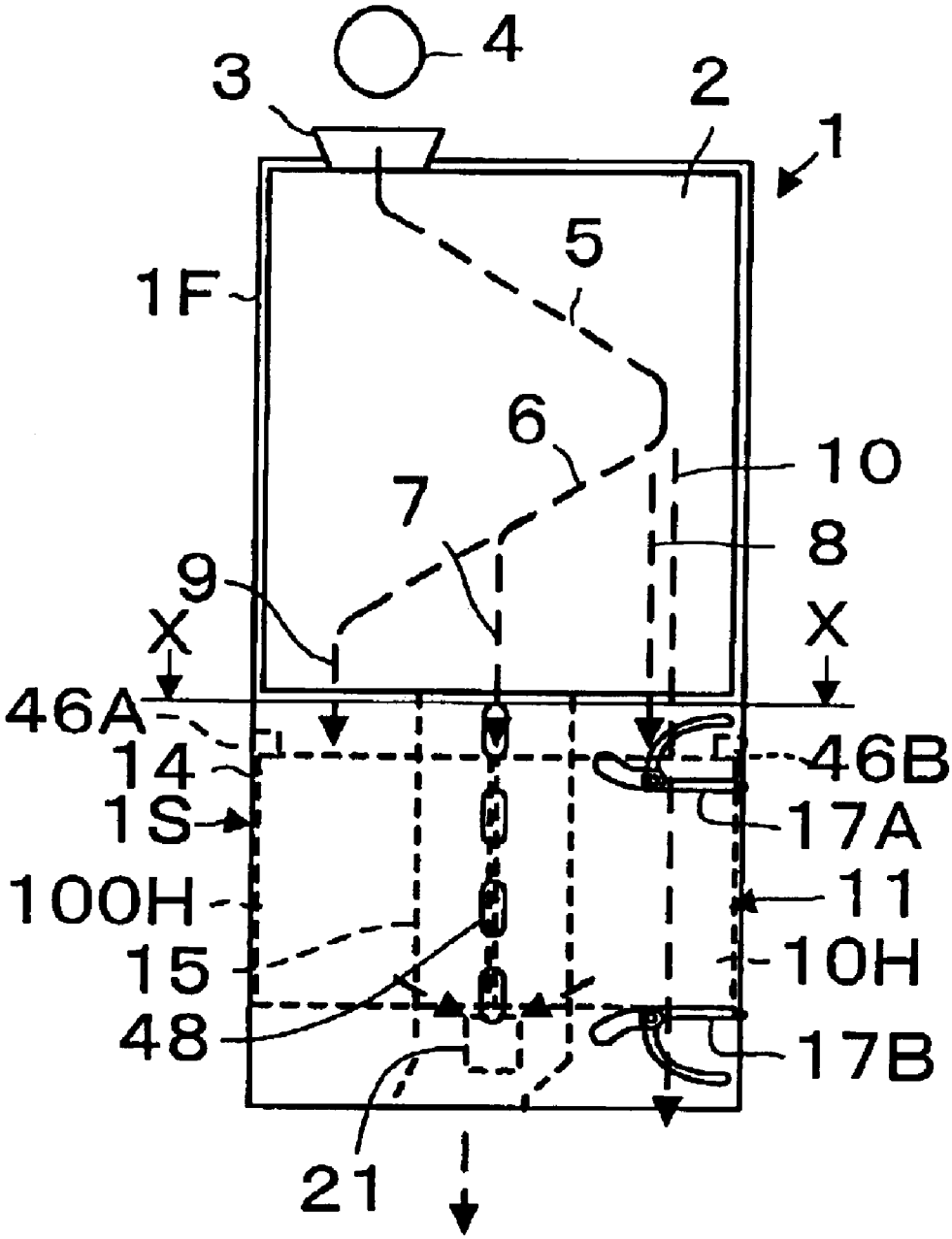
FIG. 1 is a schematic front view of the coin mechanical with the coin dispensing device of the a first embodiment.

As known a coin selector 2 is located at the upper section of a housing frame 1F which is box like in shape for a coin mechanical device as shown in FIG. 1. The coin selector 2 distinguishes coins 4 which are charged from a coin entry 3 and the coins 4 are diverted into passageways as they roll along the diverting passageway 6. False coins are diverted into a returning passageway 7 which are guided to the returning outlet. A 10 Yen coin is diverted into a first receiving passageway 8. A 100 Yen coin is diverted into a second receiving passageway 9. When the corresponding coin hopper for the denomination is full, the coins are guided into a backup passageway 10 for storing in a backup safe as known in the art.

A coin dispensing device 11 is located at the coin storing section 1S which is located under the coin selector 2. In other words, the coin hoppers store and dispense the coins, and they are located in the coin storing section 1S. The coin selector 2 and the coin dispensing device 11 are attached to the same frame 1F, however they can be attached at different frames and the frames could be combined by a connector.

A structure which can separate the coin selector 2 and the coin dispensing device 11 is convenient, because when either the selector 2 or the coin dispensing device 11 breaks down or the denominations of coins are changed, the broke-down device or the selector 2 can be changed to another device. In the first embodiment, a first coin hopper 100H for 100 Yen and a second coin hopper 10H are located parallel and in the lateral direction.

Figure 2:
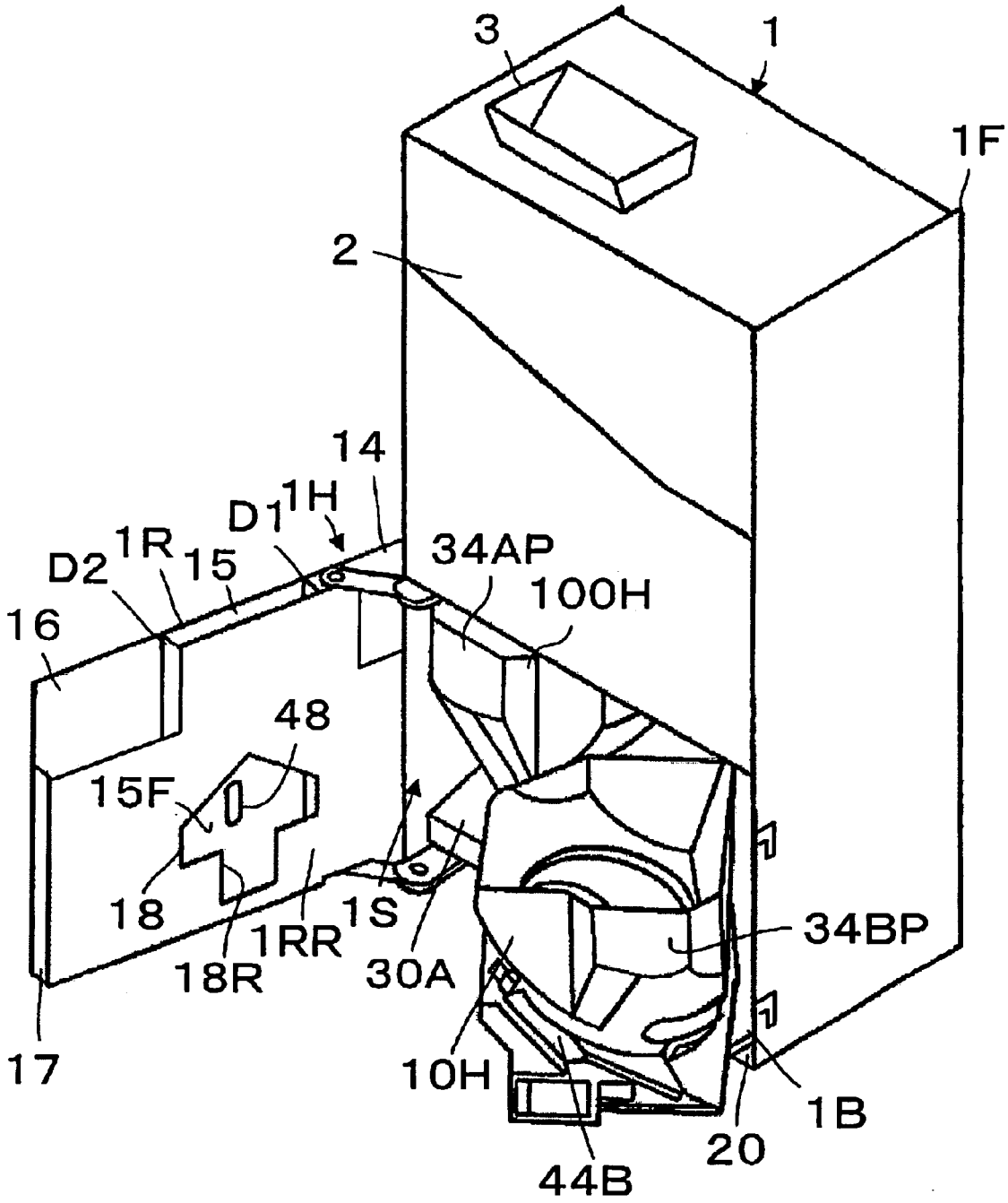
FIG. 2 is a perspective view of the coin mechanical of the first embodiment.

Lid 1R or cover member is hinged at the frame 1F by hinge 1H, and the coin storing section 1S is closed by the lid 1R as shown in FIG. 2. Dispensing passageway 15 is approximately vertical and is made up by a first partition D1 and a second partition D2 at lid 1R. Notch 14 is rectangular and is located at the rear 1RR of the left side of the dispensing passageway 15 and accommodates the bulge 34AP of the first coin hopper 100H.

Notch 16 is rectangular in shape and is located at the rear 1RR of the right side of the dispensing passageway 15 and accommodates the bulge 34BP of the second coin hopper 10H. The dispensing passageway 15 is adjacent to the side of the first coin hopper 100H and the second coin hopper 10H and is face-to-face with the coin hoppers of the same length.

Figure 3:
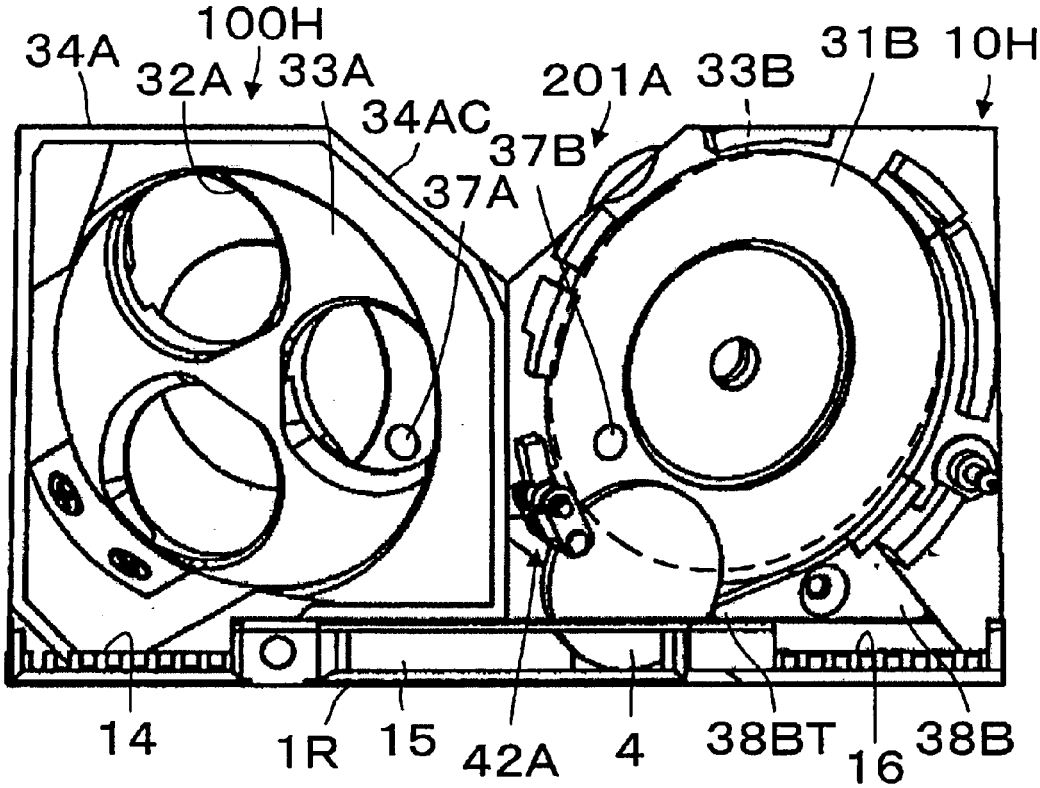
FIG. 3 is a cross-section view of X—X line in FIG. 1.

In other words, in the front view (shown in FIG. 1), the dispensing passageway 15 overlaps with the first coin hopper 100H and the second coin hopper 10H. Preferably rotating discs 33A and 33B are face-to-face and connect to exit apertures connecting with the coin dispensing passageway 15 of a horizontal length as shown in FIG. 3 to service both coin hoppers.

The coin dispensing passageway 15 is rectangular in cross section and is thicker than the coins 4 to be dispensed. As a result the coins will fall smoothly. The thickness of the coin dispensing passageway 15 is bigger than the thickness of one coin but smaller than the thickness of three coins, because the coin dispensing device 11 becomes smaller, in other words the depth of the coin mechanical device becomes short.

With this thickness, when the two coins are dispensed into the coin dispensing passageway 15 at the same time, the coins don't jam. When the coin hoppers are controlled so that they don't dispense at the same time, the thickness can be smaller than the thickness of two coins. The width of the coin dispensing passageway 15 is larger than the diameter of the maximum coin.

Locking devices 17A and 17B are attached at the front and right section of the lid 1R to lock the lid 1R to the frame 1F. Incorporating opening 18 is configured like an arrow shaped upwards and is face to face with the dispensing passageway 15 at the rear 1RR which faces the coin storing section 1S. Incorporating opening 18 is face to face with dispensing mouth 42A as will be explained later.

The first coin hopper 100H and the second coin hopper 10H can be moved in or out the coin storing section 1S. Therefore the refilling of the coins and maintenance of the coin hoppers are convenient. In other words, the first coin hopper 100H and the second coin hopper 10H can slide relative to base 1B of frame 1F by a sliding mounting device 20.

Figure 7:
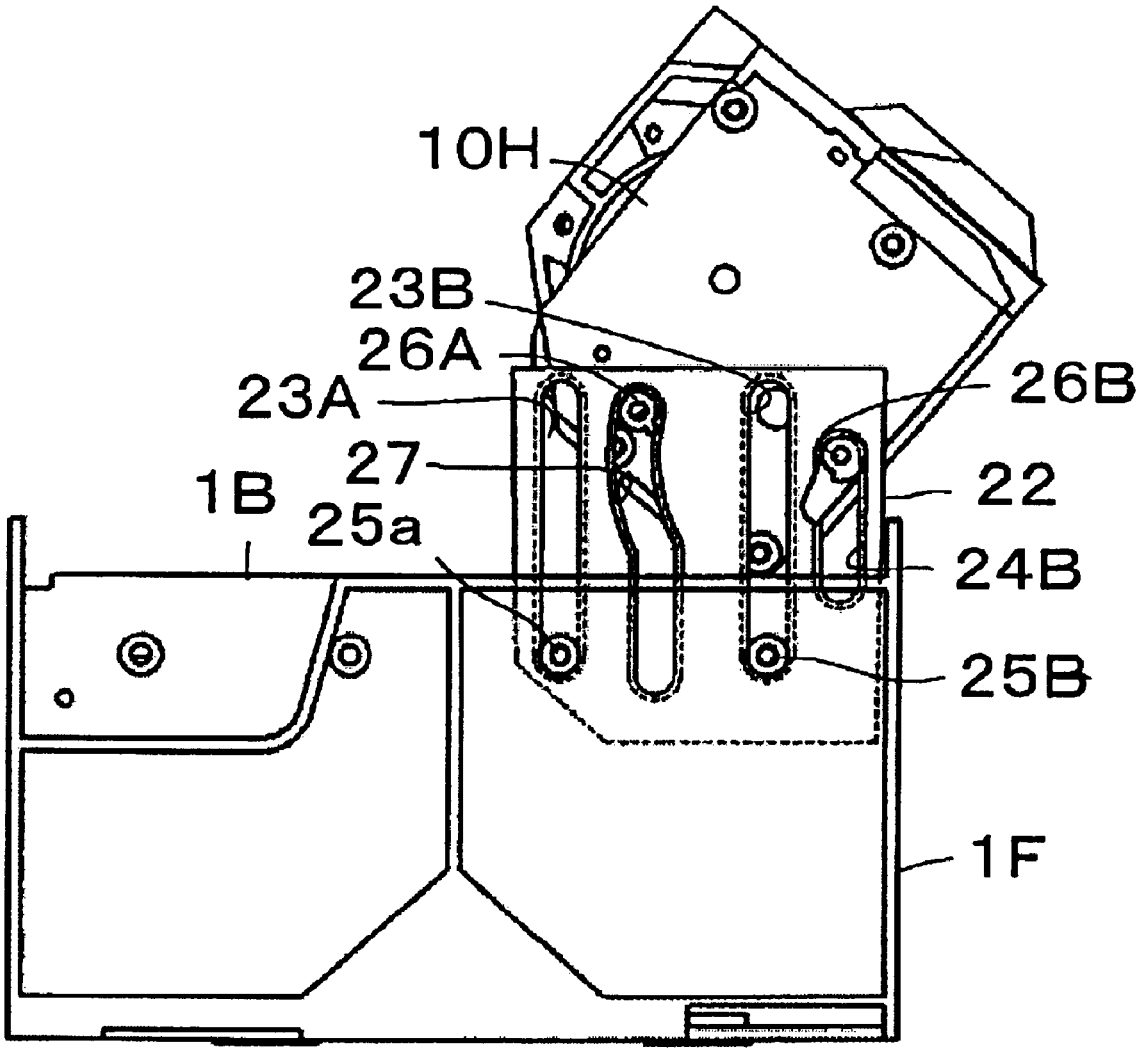

Next, the sliding mounting device 20 is explained. The sliding mounting device 20 of the second coin hopper 10H is explained by referring to FIG. 4 through to FIG. 7, because the sliding mounting devices 20 of the first coin hopper 100H and the second coin hopper 10 are the same (only the directions are different). A guide 21 is shaped like a rectangular prism and is fixed at base 1B which is located at the center of the coin storing section 1S. Sliding base 22 is located between the guide 21 and the side wall of frame 1F.

Elongated holes 23A, 23B and 24B are positioned parallel to each other and are located at the sliding base 22. Pins 25A and 25B are inserted into each of the elongated holes 23A and 23B. The pins 25A and 25B are fixed at the front section of the base 1B. The elongated holes 23A and 23B are parallel to the sliding direction of the sliding base 22. Therefore the drawing position of the sliding base 22 is limited. The head sections of the pins 25A and 25B are as large as the diameter of the flange, and doesn't guide the sliding base 22 away from base 1B.

Pins 26A and 26B penetrate through the elongated holes 24A and 24B. The pins 26A and 26B are fixed at the reverse of the second coin hopper 10H. The edges of pins 26A and 26B cannot be pulled out from the elongated holes 24A and 24B, because they have a larger diameter than the flange shape. A linear moving device includes the elongated holes 23A, 23B, 24A and the pins 26A, 26B.

The elongated hole 24B is shorter than the elongated hole 24A and has a detachable section 24BP which is triangular in the middle. The width of detachable section 24BP is larger than the large diameter section of the pin 26B. Arc section 27 is the center at the front edge section and is located from the middle section to the front end section of the elongated hole 24A. Pivoting device includes the arc section 27, the front edge section of the elongated hole 24B, pins 25A and 25B. Pins 26A and 26B are located at the rear section of the elongated holes 24A and 24B.

Figure 4:
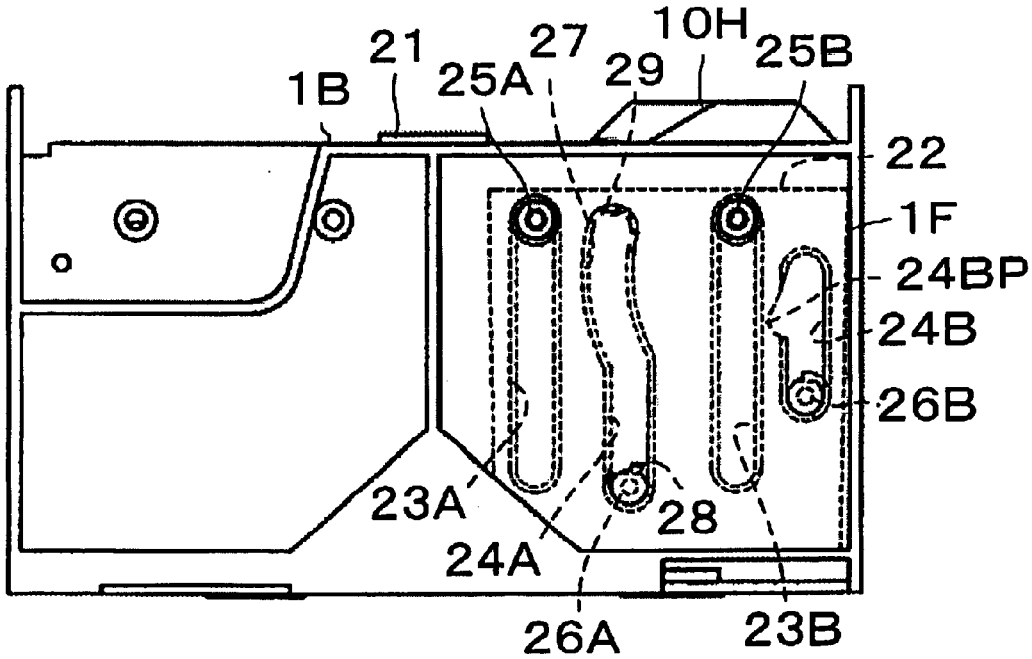
FIG. 4 is a bottom plan view of the extending device of the coin hopper of the first embodiment.

When the second coin hopper 10H is stored in the coin storing section 1S, the pins 25A and 25B are located at the front edge section of the elongated holes 23A and 23B as shown in FIG. 4. The pins 26A and 26B are located at the rear section of the elongated holes 24A and 24B.

Figure 5:
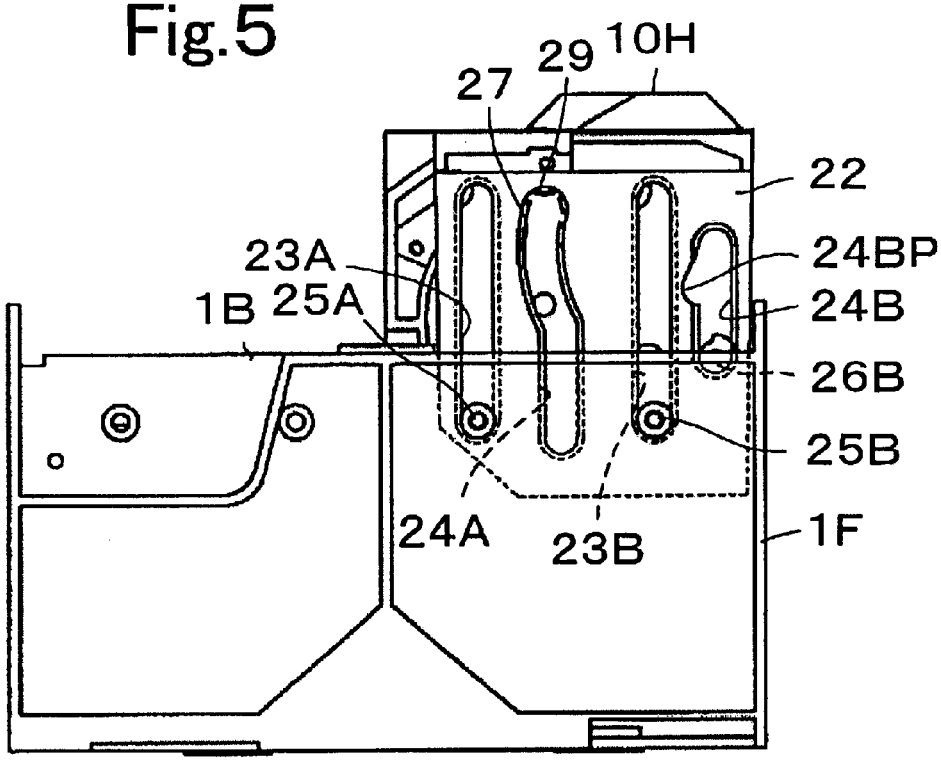
FIGS. 5 through to 8 are the operational views of the extending device of the coin hopper of the first embodiment.

In this situation, when the second coin hopper 10H is extracted, the liner moving device operates. In other words, the sliding base 22 is guided by the pins 25A, 25B, guide 21 and the side wall of frame 1F and is moved to base 1B, and is extracted outward of the coin selector 2. The sliding base 22 stops and pins 25A and 25B have contact with the rear section of elongated holes 23A and 23B (shown in FIG. 5).

Figure 6:
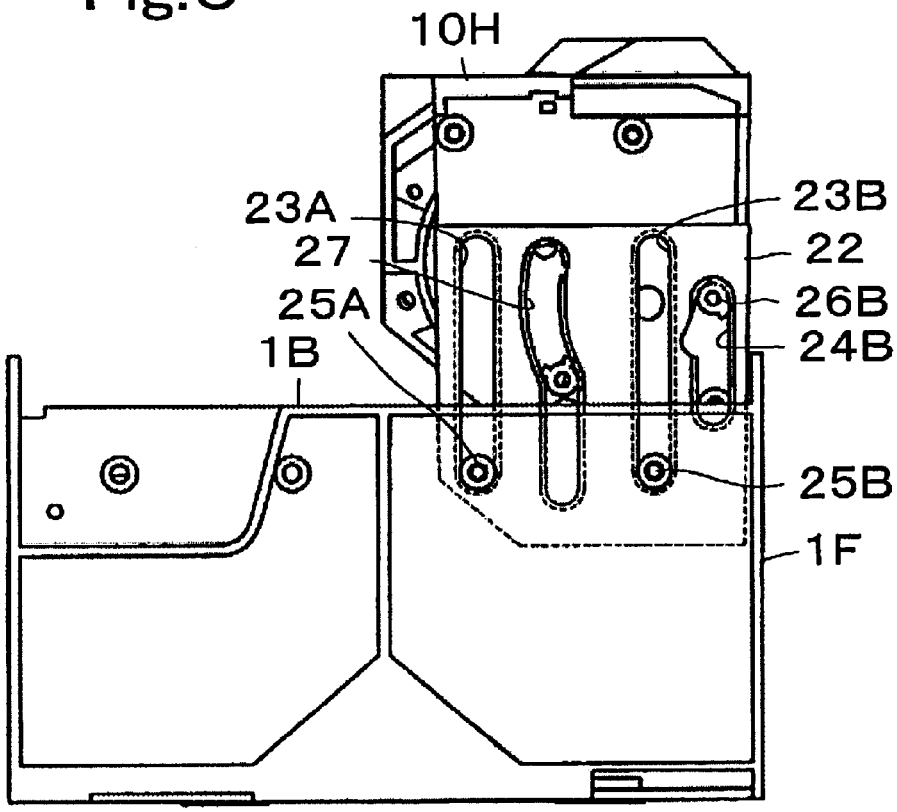

Additionally when the second coin hopper 10H is extracted, pins 26A and 26B of the back of the second coin hopper 10H are guided by the elongated hole 24A and 24B. Therefore the coin hopper 10H displaces along the slide base 22. Also the pin 26B is stopped by the edge of the elongated hole 24B (shown in FIG. 6). In this situation, approximately all of the second coin hopper 10H has been extracted from the coin storing section 1S.

Next the pivoting device is used. When the second hopper 10H is pivoted in the clockwise direction shown in FIG. 6, the pin 26B which is located at the front edge section of the elongated hole 24B becomes the point of support. Therefore pin 26A moves in the arc section 27 and is stopped by the edge of the elongated hole 24A (shown in FIG. 7). By the pivot motion, the second coin hopper 10H pivots out to one side of an extending line of the coin storing section 1S (shown in FIG. 7).

Therefore the coin refilling work is easy to accomplish, because the storing bowl 34B of the second coin hopper 10H is now located out side of the coin storing section 1S. In this situation, when the second coin hopper 10H is pivoted in the clockwise direction, the pin 26B is located at the detachable section 24BP. Therefore the head section of pin 26B can be pulled from the elongated hole 24B.

Also notch 28 is made up at the large diameter section of pin 26A and is face to face with notch 29 of the edge of elongated hole 24A. Therefore the pin 26A can be removed from elongated hole 24A.

Figure 8:
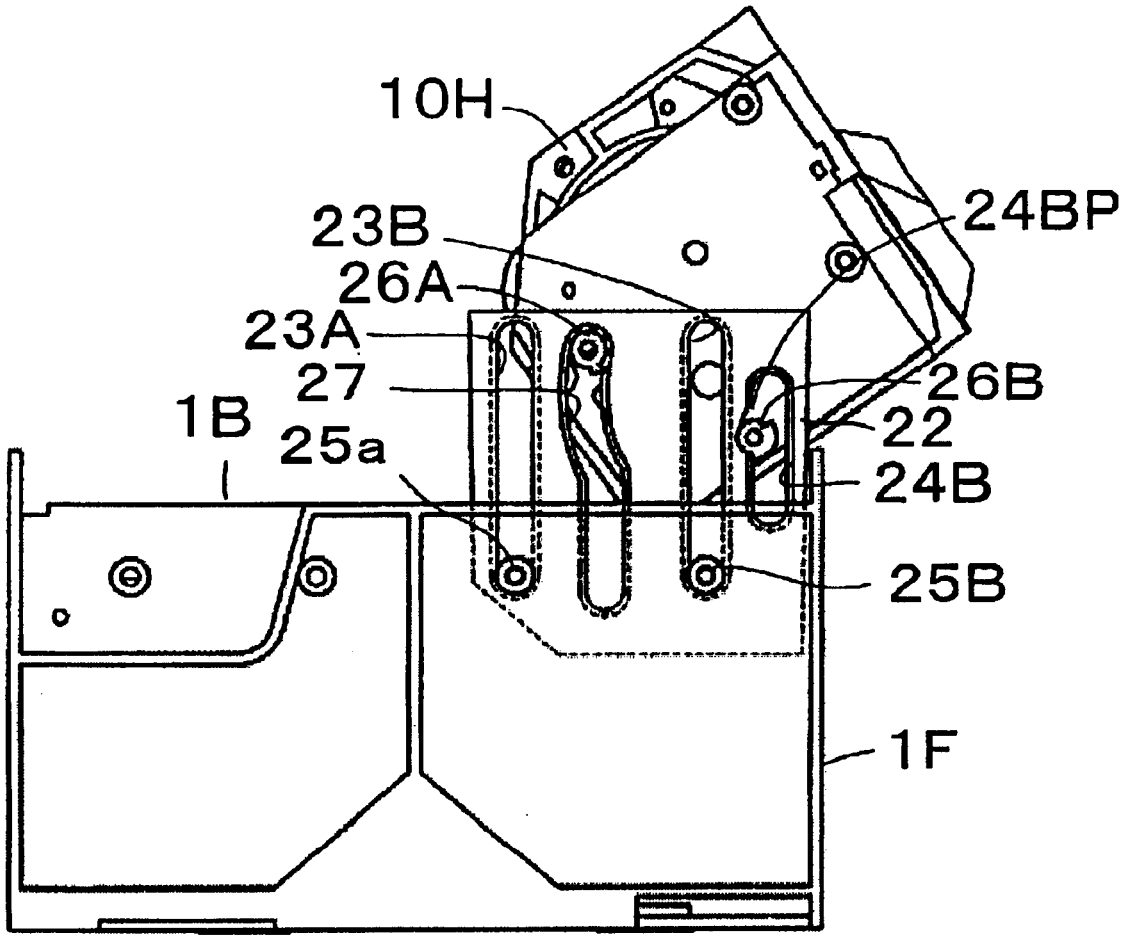

As a result the second coin hopper 10H can also be removed from the sliding base 22 (shown in FIG. 8). The detachable section 24BP, notch 28 and 29 enables a detachable device.

When the second coin hopper 10H is put in the coin storing section 1S, it is executed in an opposed manner to the aforesaid work. In this present invention, the coin refilling work could be accomplished in the situation where the second coin hopper 10H is only linearly extracted from the coin storing section 1S. But when the coin refilling work can be executed in a situation where the coin hopper pivots, the coin refilling work is made easier.

Figure 9:
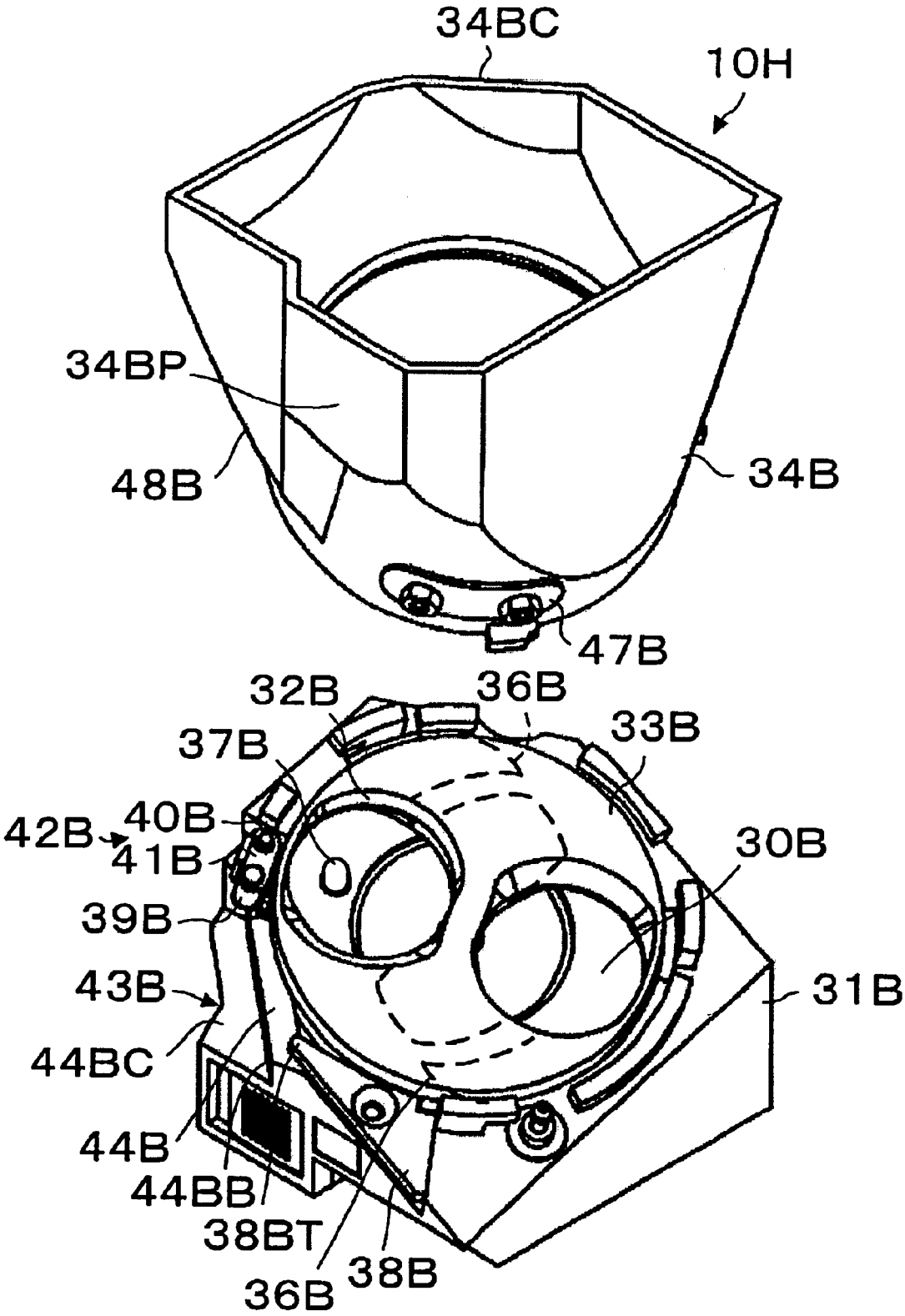
FIG. 9 is an exploded perspective view of the coin hopper of the first embodiment.

Next the structure of the coin hopper is explained. The second coin hopper 10H is explained by referring to FIG. 9, because the first coin hopper 100H and the second coin hopper 10H are located symmetric to each other and they have the same structure.

The parts of the first coin hopper are attached in the same number as the parts of the second coin hopper 10H and the figure references are changed from B to A. The second coin hopper 10H includes a hopper base 31B which has a slanting surface 30B, a rotating disc 33B which has a through hole 32B and a storing bowl 34B which is cylindrical. There are two through holes 32B and they are located symmetric to the rotating axis line. When the through holes are plural in number, the probability of the coins passing increases. Therefore the coin dispensing time is reduced, however, the through hole can be limited to one.

A rotating disc 33B is located adjacent to the slanting slid surface 30B and is parallel to the disc 33B and is rotated by a second electric motor 35B which is thin and is built in the hopper base 31B. The rotating disc 33B is made of a material which can be a resin or metal, etc. A preferred production method is to make the hopper parts by an integral molding procedure with resin. Therefore storing bowl 34B is made of a resin and is made by integral molding, and the lower section is circular, and the lower section is fixed detachable at the slanting slide surface 30B.

The upper section of a storing bowl 34B has chamfers and is approximately pentagonal in shape. Preferably the storing bowl 34B is rectangular for increasing the volume for stored coins. But an approximate round shape is suitable, because such a shape can increase the stirrer effect by the rotating disc 33B. When the storing bowl 34B is pentagon, the dispensing of the coins becomes smooth for easy movement of coins.

The storing bowl 34B has a bulge 34BP to receive the coins. The bulges 34BP and 34AP are located on both sides of the dispensing passageway 15. The rotating disc 33B is located in the lower section of the storing bowl 34B. A pushing protrusion 36B has a curved shape which is extended from the center of the rotating disc 33B and is located at the reverse of the disc 33B and is face to face with a through hole 32B. The hopper base 31B is a box which is made of a resin, and the upper surface is the slanting slide surface 30B.

A stopping pin 37B is fixed at the middle of the front and downward slope and is located at the first coin hopper 100H side of the slanting slide surface 30B. The stopping pin 37B protrudes over the slanting slide surface 30B by a spring (not shown) and can be pushed down by a predetermined downward force. Accordingly the stopping pin 37B is retracted back into the hopper base 31B. When the rotating disc 33B is reversed in rotation, the coins can pass over the stopping pin 37B because the protruding end of the stopping pin 37B is semi-round and the stopping pin 37B can be pushed downward.

Dispensing guide 38B has a triangular shape and is fixed at the lower section of the downward slope of the slanting slide surface 30B and is further located on the outside of the rotating disc 33B. The dispensing guide 38B is made of metal which prevents wear and tear by the coins 4. Roller 39B is located away from the end 38BT of dispensing guide 38B, and the distance is shorter than the coin's diameter.

The roller 39B is rotatable at the end of a lever 41B which pivots at shaft 40B which in turn is fixed at the slanting slide surface 30B. The lever 41B pivots in the counter clockwise direction by a spring (not shown), and it stops on the out side of the rotating disc 33B by a stopper (not shown). The roller 39B, the shaft 40B and the lever 41B provide the structure of coin projector 42B.

Coin dispensing mouth or aperture 43B is the space between the end 38BT of the dispensing guide 38B and roller 39B. Dispensing guide surface 44B is on the outside of the coin dispensing mouth 43B which slants downwards and towards the dispensing passageway 15. Tier 44BB is located on and continues to the slanting guide surface 44B, and slanting guide surface 44BC is formed the same as the surface 44B. The opposed surface to the dispensing guiding surface 44B of the storing bowl 34B is a downward slanting guide surface 48B which slants downwards.

Figure 10:
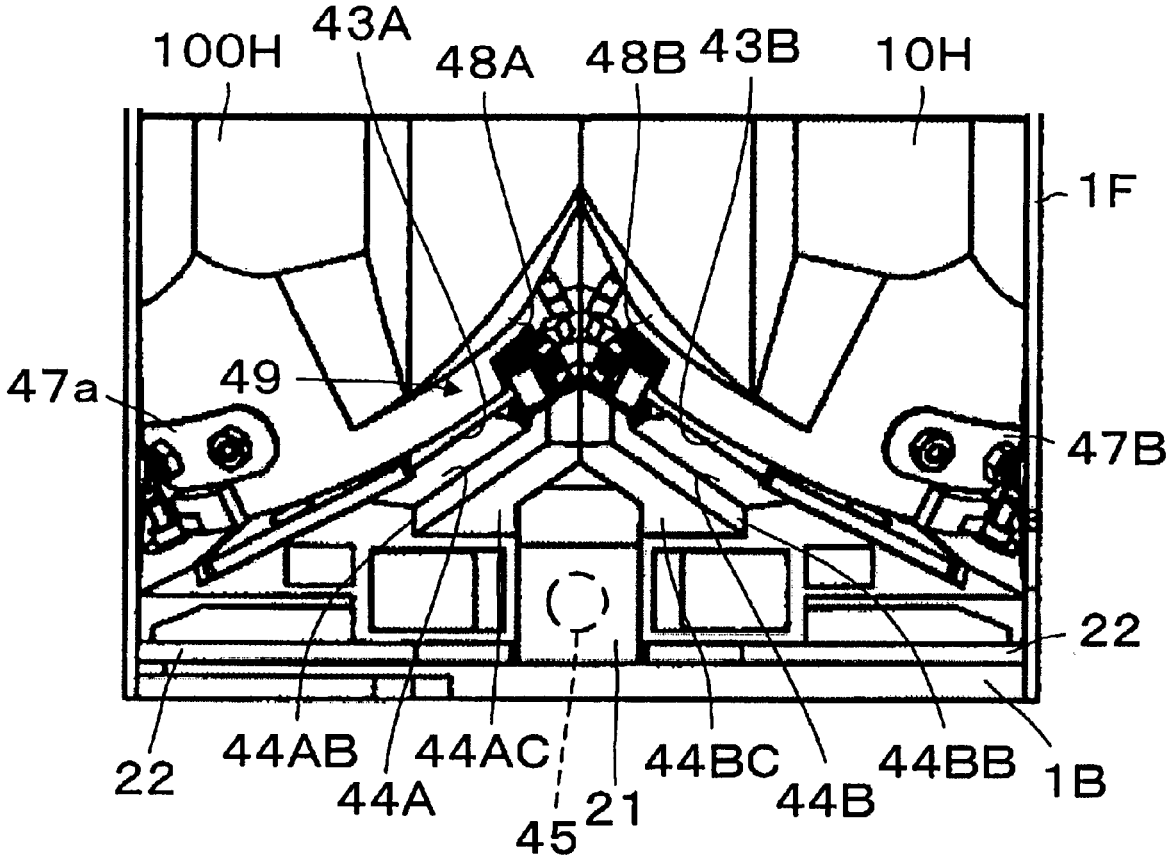
FIG. 10 is a front view that the coin hopper built into the coin mechanical.

Therefore the dispensing guide surface 44A of the first coin hopper 100H, tier 44AB, guiding surface 44AC, downwards slanting guide surface 48A, dispensing guide surface 44B of the second coin hopper 10H, tier 44BB and downwards slanting guide surface 48B create a guiding section 49 which is a pyramid shape as shown in FIG. 10. The bottom of the guiding section 49 is front wall 15F.

Accordingly when the dispensing coins from either the coin hopper 100H or 10H rebound from the front wall 15F, the coins are guided by the guiding surfaces 44A, 44AB, 44AC, 44B, 44BB, 44BC, 48A, 48B and the front wall 15F, and are guided into the dispensing passageway 15. In this structure, the coins are stirred by the rotation of rotating disc 33B and pass through the hole 32B and are supported by the slanting slide surface 30B.

Coin 4 is pushed in the clockwise direction by the pushing protrusion 36B and slides on the slanting slide surface 30B, and is stopped by the stopping pin 37B. The stopped coin 4 is additionally pushed by the pushing protrusion 36B and goes to the projector 42B side and is guided by the dispensing guide 38B. Accordingly the roller 39B is slightly moved in the clockwise direction by the coin 4. Afterwards coin 4 is dispensed by coin projector 42B and is dispensed from the coin dispensing mouth 43B.

In the process of pushing the coin 4 by pushing the protrusion 36B, the edge of the coin 4 passes through the opening 18 and arrives into the dispensing passageway 15 therefore the coin 4 has contact with the front wall 15F. Accordingly the coin 4 is placed in a position which slants downwards towards the front in accordance with the dispensing guide surface 44B. Therefore the coin 4 has contact with the front wall 15F at a relatively blunt angle. The direction of coin 4 is changed to a downward direction by the front wall 15F and the dispensing guide surface 44B. In this process, the tier 44BB and the dispensing guide surface 44B don't obstruct the coin 4.

The diameter section of the coin 4 passes through between the end 38BT and the roller 39B, whereupon the coin 4 is flipped by the coin projector 42*a*. Therefore the coin 4 falls down and is guided by the dispensing passageway 15 at the same time, and it is guided to the dispensing mouth of the vending machine. When the slanting slide surface 30B is viewed from the lid 1R side, the surface 30B is slanted, and has a three-dimensional area which slants downwards to the lid 1R opposed the frame 1F and slants downwards from the first coin hopper 100H side.

Figure 11:
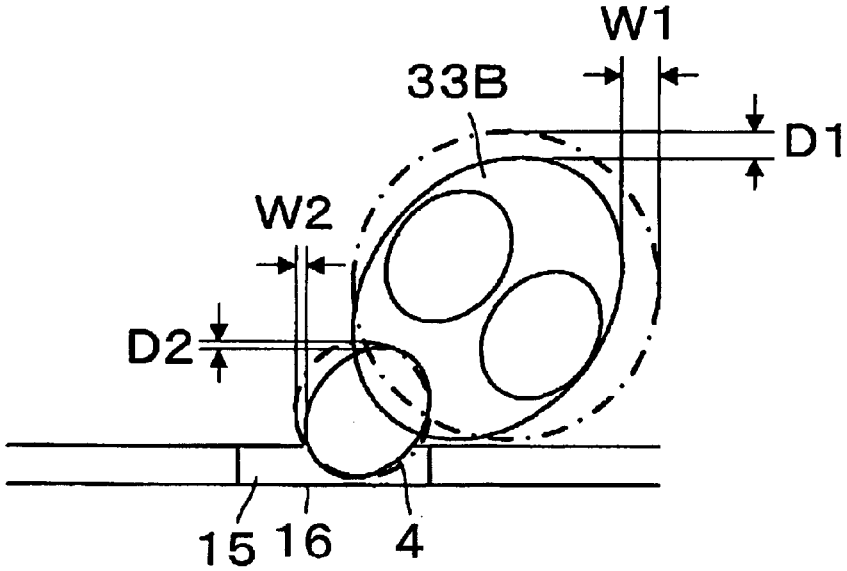
FIG. 11 is a schematic diagram to explain the first embodiment.

The slanting slide surface 30A of the first coin hopper 100H slants symmetrical to the slanting slide surface 30B. Therefore the slanting slide surface 30B is slanted downwards toward the lid 1R side and is slanted downwards towards the second coin hopper 10H side. The rotating disc 33A and 33B slant in accordance with the slanting slide surface 30A of 30B. In other words, the rotating discs 33A and 33B slant towards the width and depth of the coin mechanical 1. Accordingly the width of the coin mechanical device 1 reduces by an amount W1, when compared to a level layout of a rotating disc 33B (shown the by dotted line) as shown in FIG. 11.

Also, the depth of the coin mechanical 1 reduces by an amount D1. Furthermore the width reduces W2 and the depth reduces D2, because the dispensed coin 4 slants. The width of coin mechanical device 1 reduces (W1+W2)*2, because the first coin hopper 100H and the second coin hopper 10H are aligned in the lateral direction.

Next a dispensing sensor is explained. The end of guide 21 corresponds to a rectangular section 18R of the lower section of the opening 18. A dispensing sensor 45 can be a coil type and is located at one end. The dispensing sensor 45 can be changed to a photoelectric sensor. The dispensing sensor 45 has a function which detects the falling coin 4 in the dispensing passageway 15.

Next a full sensor of the coin hoppers is explained by referring to FIG. 1. First full sensor 46A is fixed at frame 1F which is face to face with a position which is located slightly upwards of the bulge 34AP and below the second receiving passageway 9. Second full sensor 46B is fixed at frame 1F which is face to face with the position which is located slightly upwards of the bulge 34BP and below the first receiving passageway 8.

The first full sensor 46A detects a full load of coins situation in the coin hopper 100H by the height of the coins. The second full sensor 46B also detects the full situation in the coin hopper 10H by the height of coins. When the full sensors 46A and 46B detect a full situation, the receiving coins are guided into a backup safe. The full sensors 46A and 46B can be changed to a photoelectric type or a coil type, etc.

First empty sensor 47A is attached in the lower section of the storing bowl 34A. Second empty sensor 47B is attached in the lower section of the storing bowl 34B. The empty sensors 47A and 47B detect an empty situation of coins in the coin hopper 34A or 34B. Therefore the empty sensors 47A and 47B can be changed to another detecting type. Additionally observation holes 48 for a service technician are located at the front wall 15F of the lid 1R along the dispensing passageway 15.

Figure 12:
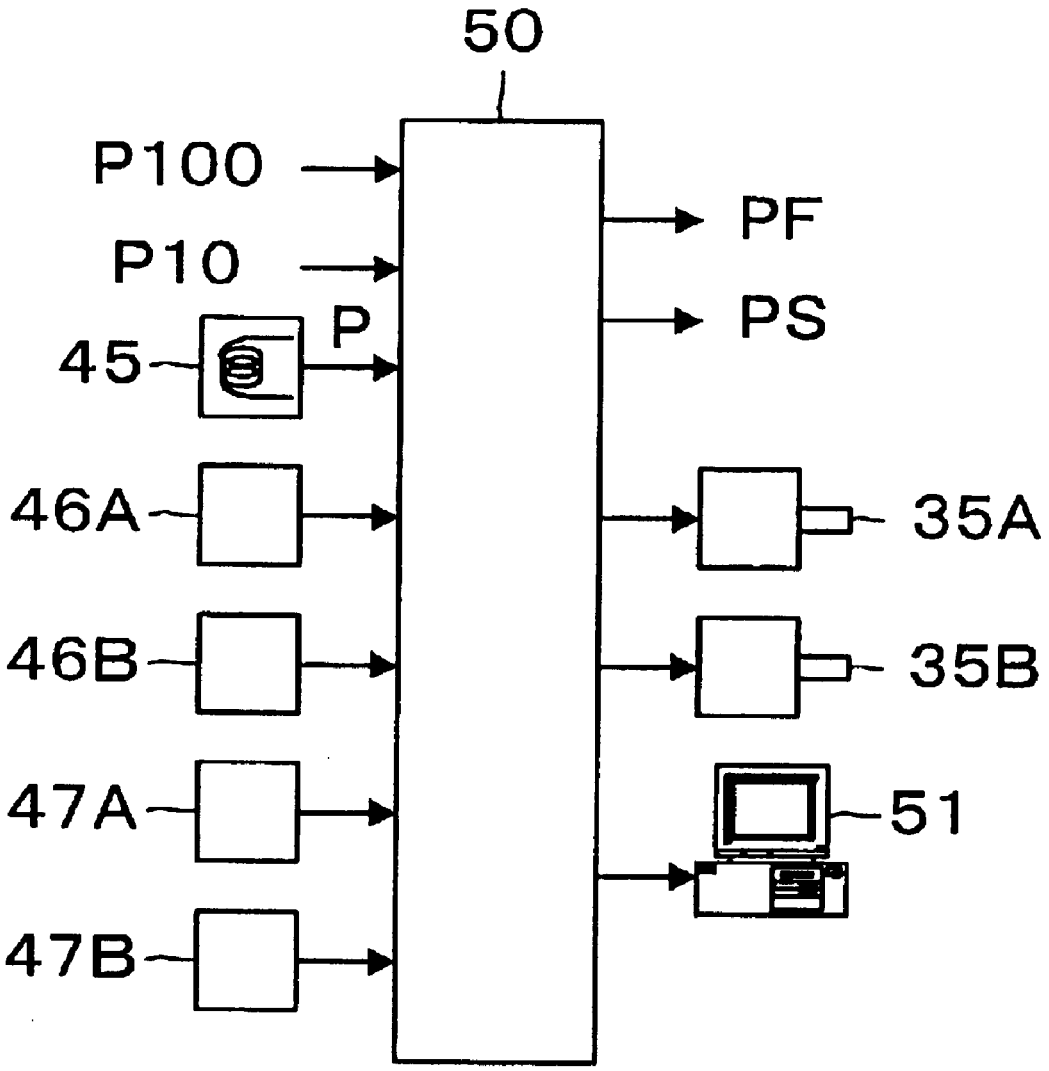
FIG. 12 is a block diagram of the controls of the first embodiment.

Next the control block diagram is explained by referring to FIG. 12. Micro processor 50 receives signals from dispensing signal P100 and P10, the dispensing sensor 45, the first full sensor 46A, the second full sensor 46B, the first empty sensor 47A, and the second empty sensor 47B. The micro processor 50 selectively drives an electric motor 35A of the first coin hopper 100H, an electric motor 35B of the second coin hopper 10H and outputs a finished signal PF and outputs a display to display 51 and/or printer, etc. based on the installed control program.

Figure 13:
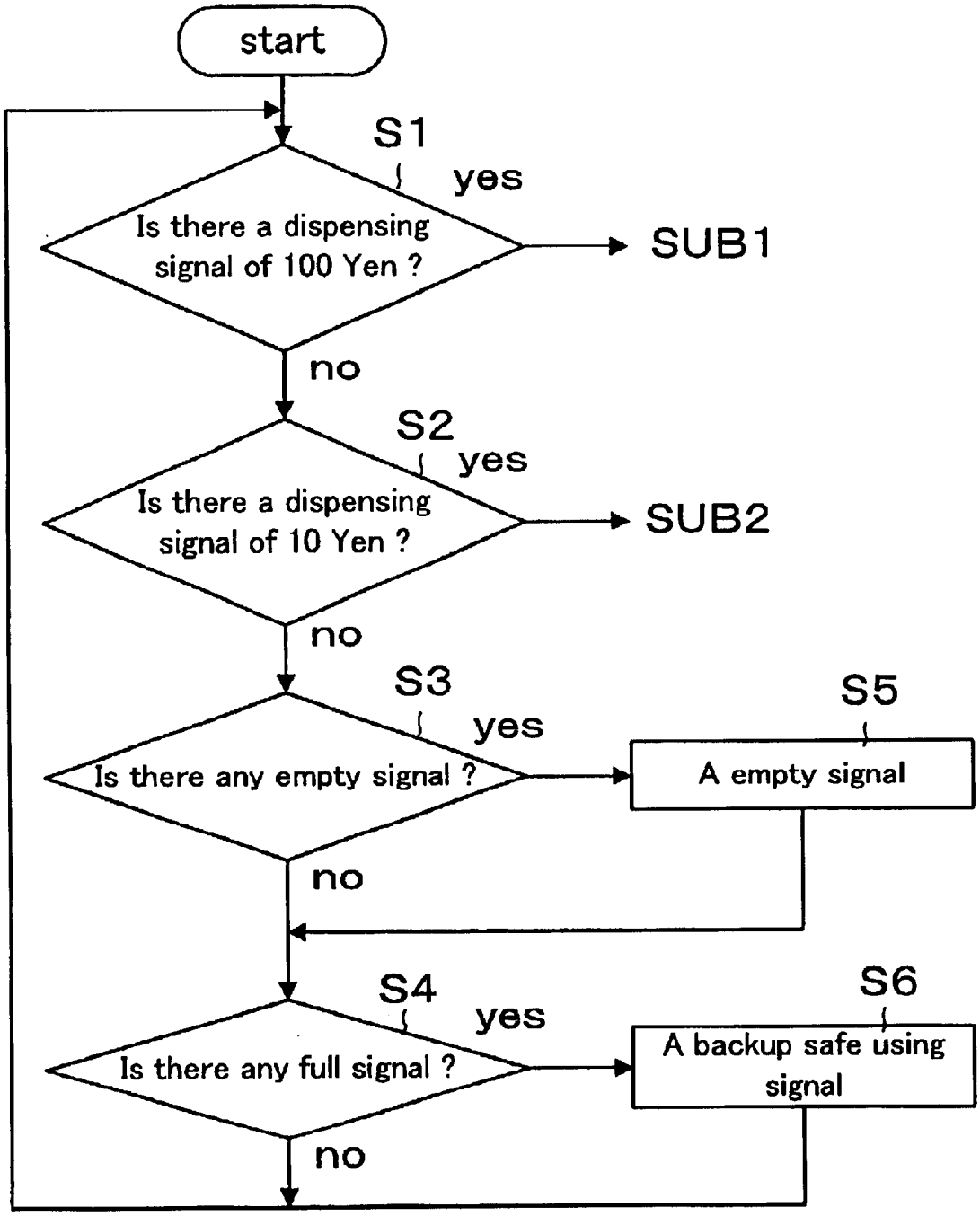
FIG. 13 through to FIG. 15 are the flow charts for the operation of the first embodiment.
Figure 14:
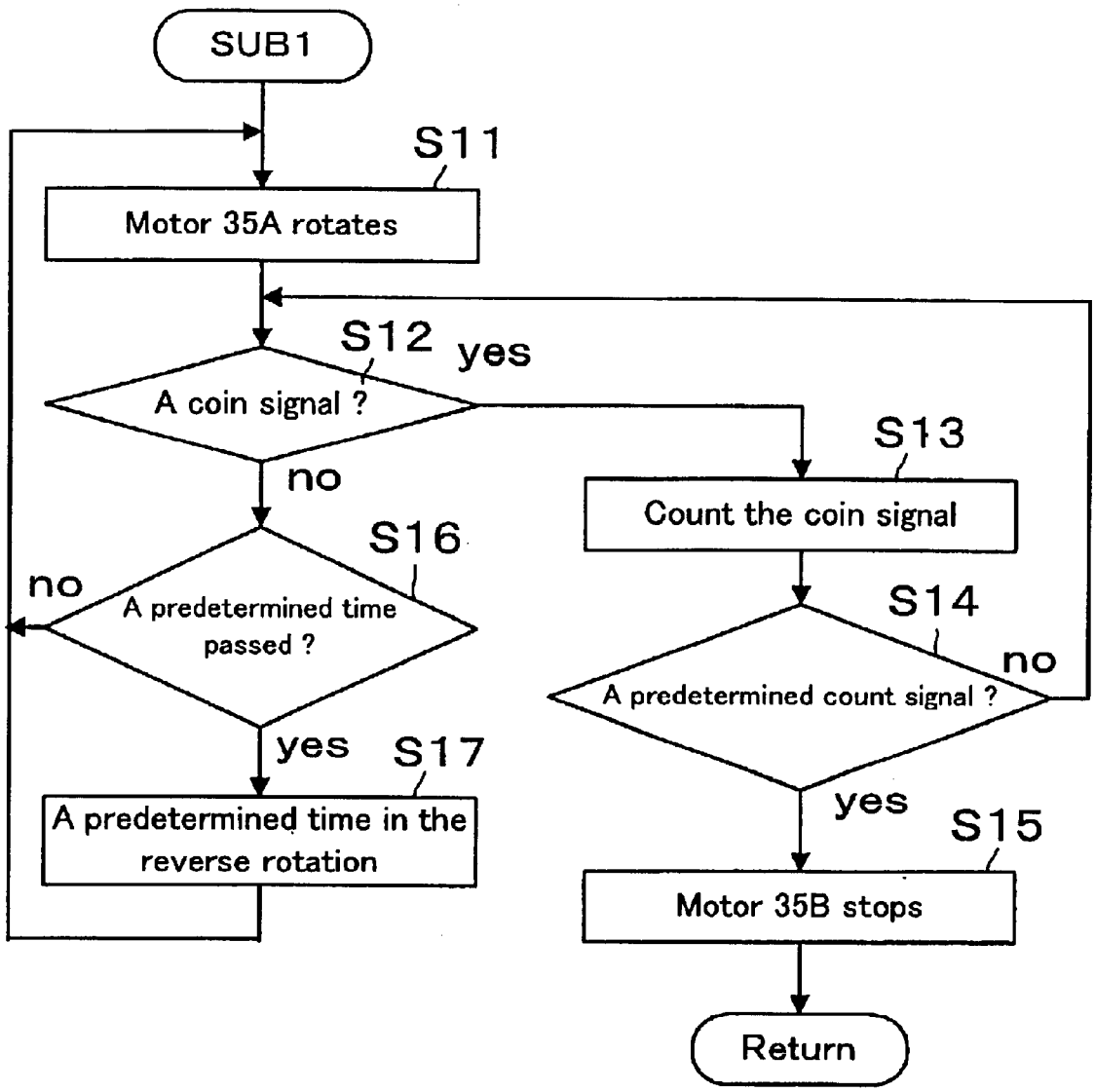
Figure 15:
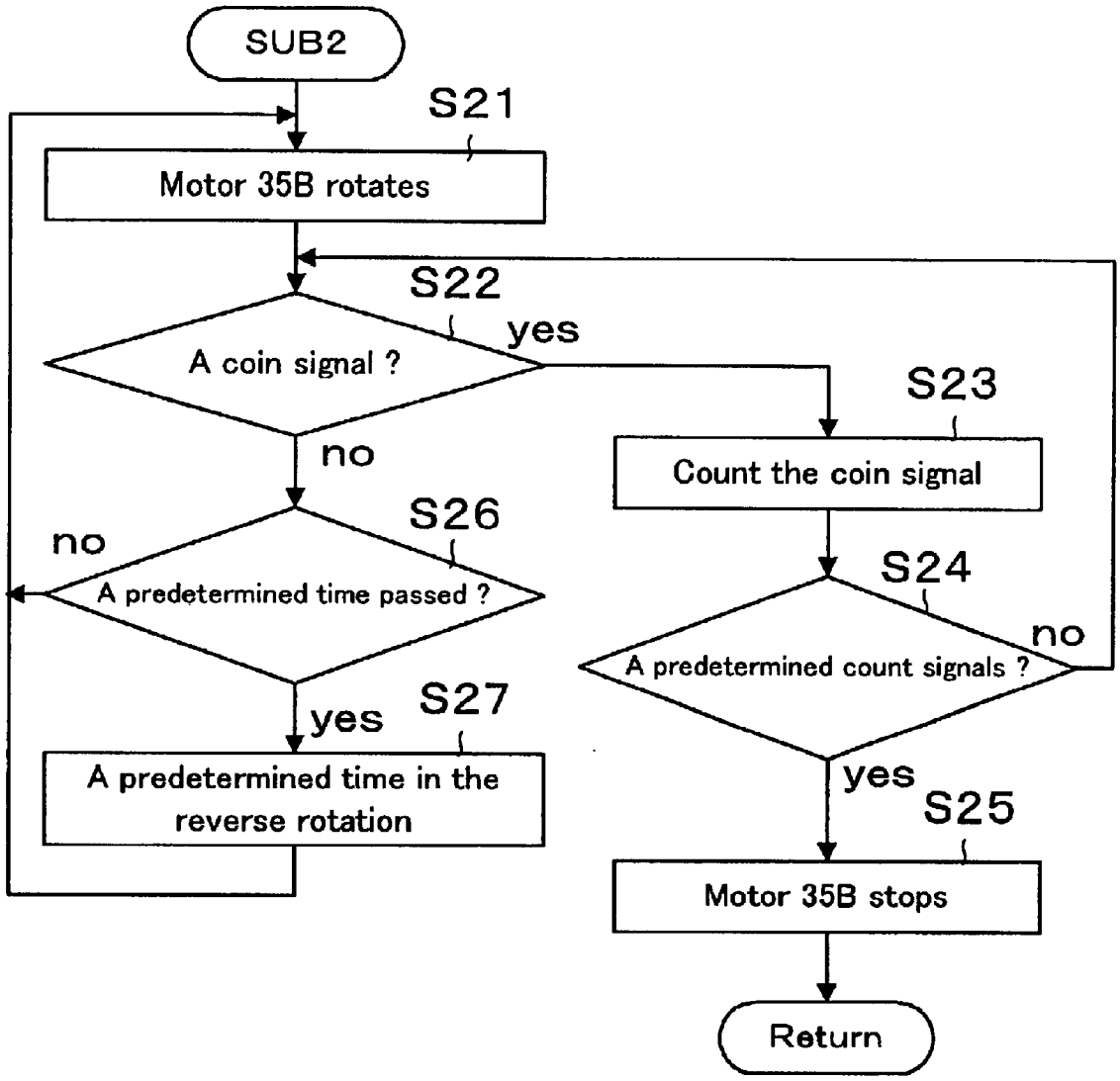

The operation of the first embodiment is explained by referring to FIG. 13 through to FIG. 15. There are 50 coins of 100 Yen in bulk in the first coin hopper 100H, and there are 50 coins of 10 Yen in bulk in the second coin hopper 10H. The case of dispensing 150 Yen is explained. Accordingly the coin mechanical device 1 receives the dispensing signal P100 which dispenses one coin of 100 Yen and the dispensing signal P10 which dispenses five coins of 10 Yen.

At step S1, when there is the dispensing signal P100, the program goes to subroutine SUB1 and when there isn't a dispensing signal P100, the program goes to step S2. At step S2, when there is a dispensing signal P10, the program goes to subroutine SUB2 and when there isn't a dispensing signal P10, the program goes to step S3.

At step S3, the empty signal of the first empty sensor 47A or the second empty sensor 47B is distinguished. When there isn't any empty signals, the program goes to step S4, and when there is at least one empty signal, the program goes to step S5. At step 5, the empty signal is outputted, and a predetermined display is displayed at display 51, etc. and the program goes to step S4.

At step S4, either the full signal of the first full sensor 46A or the full signal of the second full sensor 46B is distinguished. When there aren't any full signals, the program returns to step S1, and when there is a full signal, the program goes to step S6. At step S6, a backup safe using signal is outputted, and the program goes to step S1.

Next the operation of the subroutine 1 is explained. At step S11, electrical motor 35A of the first coin hopper 100H rotates. The rotating disc 33A is rotated by the electrical motor 35A. Therefore one coin of 100 Yen is dispensed into the dispensing passageway 15.

The dispensed coin of 100 Yen falls down through the dispensing passageway 15 and is guided to the dispensing mouth of the vending machine. The dispensing sensor 45 outputs the detecting signal P. At step S12, the detecting signal P is distinguished, and the program goes to step S13.

At step S13, the detecting signal P is counted. In this case, if it is the first time, therefore one is counted. At step S14, the counted number is compared to the set instruction number. In this case, the instruction number is one, and is the same as the counted number. Accordingly the program goes to step S15, and the electrical motor 35A is stopped, and the program returns to the main routine.

Additionally the counted number of the 100 Yen coin is reset relatively to the stopping of the electrical motor 35A. Also the dispensing finished signal PF of 100 Yen coin is output, and only the dispensing signal P10 is output from the control device of the vending machine.

When the detecting signal P of the coin isn't detected, the program goes to step S16. At step S16, the rotating time from the start of the rotation is clocked, and is compared with a predetermined time. When the rotating time isn't over the predetermined time, the program returns to step S11.

When the rotating time is over the predetermined time, the program goes to step S17, and motor 35A rotates in a reverse direction for a predetermined time period. When the coin isn't dispensed from the start of the rotation of the rotating disc 33A within the predetermined time period, the program assumes that coins are jammed in coin hopper 100H. Accordingly the rotating disc 33A is rotated in the reverse direction in an effort to insure that jam is broken up. Next the program returns to step S11, and the motor 35A rotates in the normal direction, and a coin of 100 Yen is dispensed.

Next the process of subroutine 2 is explained. At step S21, the electrical motor 35B of the second coin hopper 10H rotates. The rotating disc 33B is rotated by the electrical motor 35B, and one coin of 10 Yen is dispensed into the dispensing passageway 15. The dispensed coin of 10 Yen falls down in the dispensing passageway 15 and is guided to the dispensing mouth of the vending machine. The coin of 10 Yen falls down into the dispensing passageway 15. Whereupon the dispensing sensor 45 outputs the detecting signal P.

At step S22, the detecting signal P is distinguished, and the program goes to step S23. At step S23, the detecting signal P is counted. In this case it is the first time, therefore one is counted. At step S24, the counted number is compared to the instruction number. In this case, the instruction number is five, and the program returns to step S22. The rotating disc 33B continually rotates, and the coins of 10 Yen are dispensed continually as has been previously described.

When five coins are dispensed, the count number becomes five, and the program goes to step S25. At step S25, the motor 35B stops and the program returns to the main routine. Additionally the count number of the 10 Yen coin is reset, and the dispensing finished signal of 10 Yen coin is outputted.

When there isn't a coin signal, the program goes to step S26. At step S26, the rotating time from the start of the rotation is checked, and is compared with a predetermined time period. When the rotating time isn't over the predetermined time, the program returns to step S21. When the rotating time is over the predetermined time, the program goes to step S27, and the motor 35B rotates in a reverse direction during a predetermined time, and any jam is broken up.

Next the program returns to step S21, and motor 35B rotates normally, and a coin of 10 Yen is dispensed. Additionally, when the dispensing coins are over two, the predetermined time of step S26 is clocked from the last output timing of the coin dispensing signal P.

Figure 16:
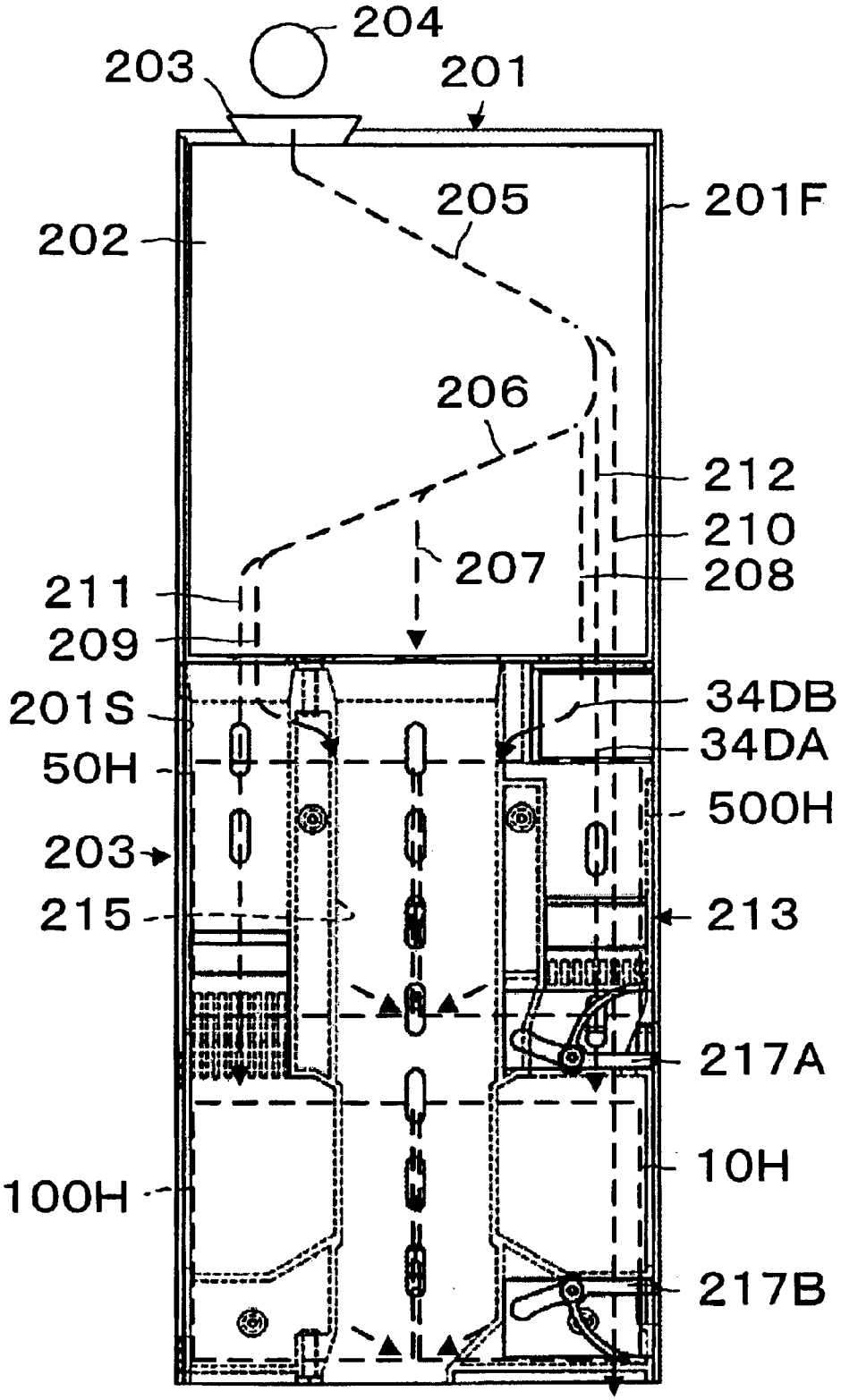
FIG. 16 is a schematic front view of a coin mechanical with a coin dispensing device of a second embodiment.
Figure 25:
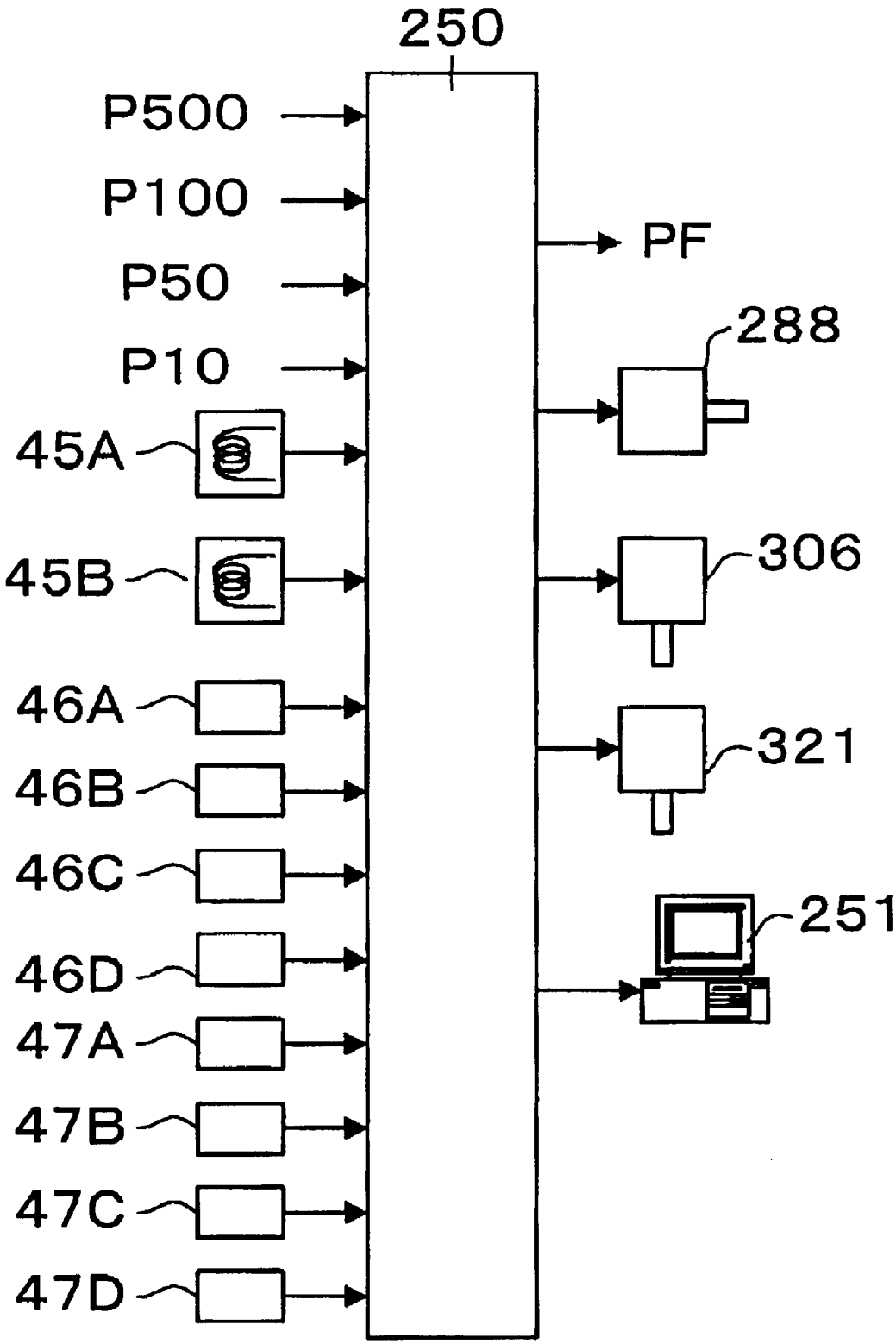
FIG. 25 is a block diagram of the controls of the second embodiment.

Next a second embodiment of the present invention is explained by referring to FIG. 16 through to FIG. 25. The second embodiment includes four coin hoppers, and four denominations wherein 500 Yen, 100 Yen, 50 Yen and 10 Yen can be dispensed. As known, a coin selector 202 is located at the upper section of a frame 201F which is box like in configuration of coin mechanical 201 as shown in FIG. 16.

The coin selector 202 distinguishes the coins 204 which are charged from coin entry 203. And the coins are diverted into passageways on the way to rolling onto the diverting passageway 206. False coins are diverted into a returning passageway 207 which are guided to the returning section. The coin of 10 Yen is diverted into a 10 Yen receiving passageway 208. The coin of 100 Yen is diverted into a 100 Yen receiving passageway 209. The coin of 50 Yen is diverted into a 50 Yen receiving passageway 211. The coin of 500 Yen is diverted into a 500 Yen receiving passageway 212. When the corresponding coin hopper for the denomination is full, the coins are guided into a backup passageway 210 for storing in a backup safe.

A coin dispensing device 213 is located at the coin storing section 201S which is located under the coin selector 202. The coin dispensing device 213 includes a first coin hopper 100H for 50 Yen, a second coin hopper 10H for 500 Yen, a third coin hopper 50H for 100 Yen, a fourth coin hopper 500H for 10 Yen and a common dispensing passageway 215.

Figure 17:
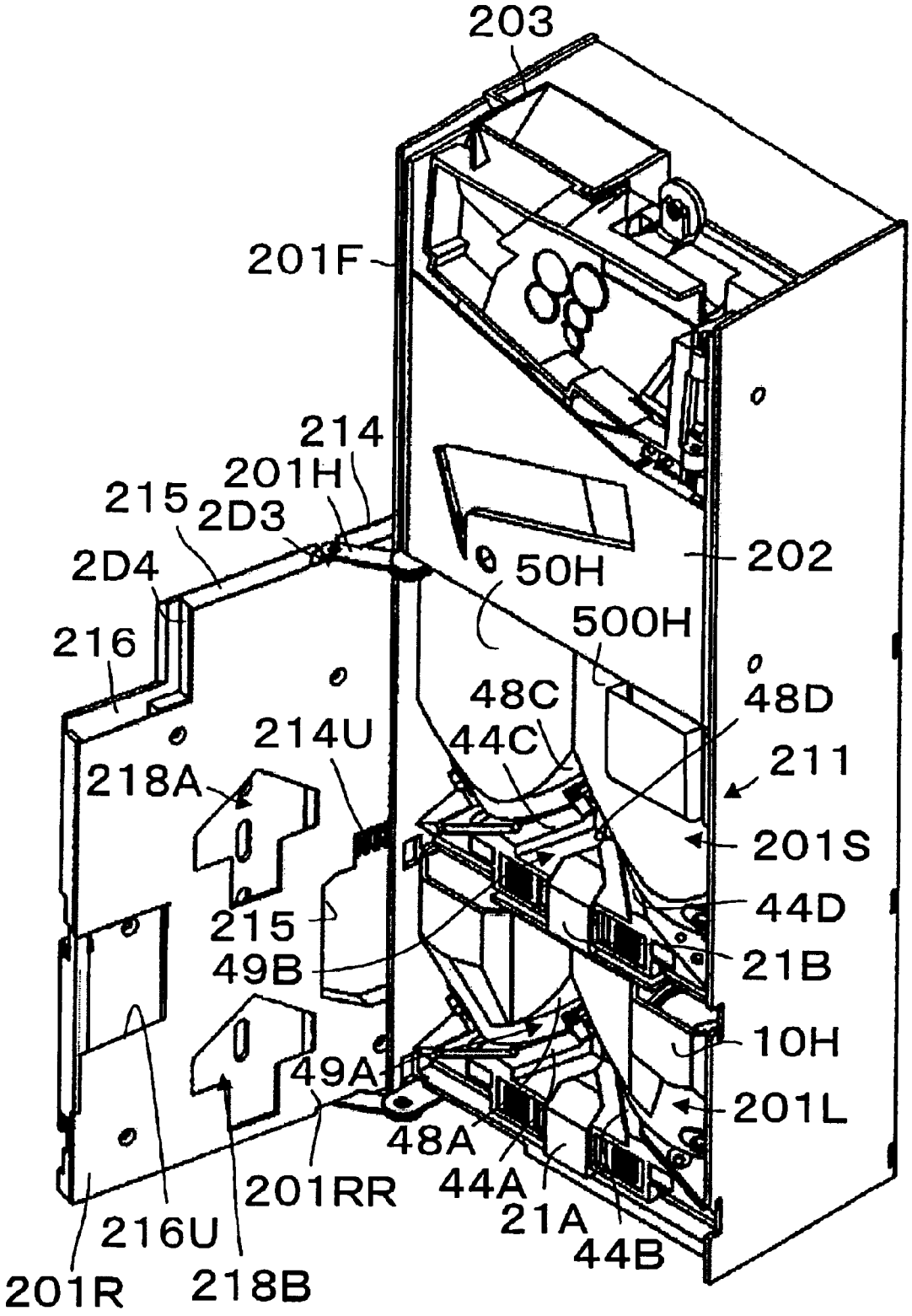
FIG. 17 is a perspective view of the lid of the coin mechanical with the coin dispensing device of the embodiment opened.

Lid 201R is hinged at frame 201F by hinge 201H, and the coin storing section 201S is closed by lid 201R as shown in FIG. 17. A third passageway 214, a common dispensing passageway 215 and a fourth passageway 216 are approximately vertical and parallel and are made up by a third partition 2D3 and a fourth partition 2D4 at lid 1R.

The dispensing passageway 215 is adjacent to the first coin hopper 100H and the second coin hopper 10H and the third coin hopper 50H and the fourth coin hopper 500H and is face-to-face with the coin hoppers. In other words, when it's viewed from the front (shown in FIG. 16), the dispensing passageway 215 is adjacent to the side which is aligned lateral to the first coin hopper 100H and the second coin hopper 10H and the side which is aligned lateral to the third coin hopper 50H and the fourth coin hopper 500H and is face-to-face with the coin hoppers.

Preferably, the rotating discs 33A, 33B, 33C and 33D overlap to the dispensing passageway 215 all at an even length. The width of the passageways 214, 215 and 216 are smaller than the diameter of two coins. The thickness of the passageways 214, 215 and 216 are smaller than the thickness of two coins.

Locking devices 217A and 217B are attached at the front right section of lid 201R, which lock lid 201R to the frame 201F. First incorporating opening 218A and second incorporating opening 218B are arrow shaped and extend upwards at the rear 201RR of the lid 201R and face to face with the coin storing section 201S. The second opening 218B is face to face with the coin dispensing mouth 43A of the first coin hopper 100H and is face to face with the coin dispensing mouth 43B of the second dispensing hopper 10H.

The first opening 218A is face to face with the coin dispensing mouth 43C of the third coin hopper 50H and is face to face with a coin dispensing mouth 43D of the fourth coin hopper 500H. Opening 214U is located at the middle at a perpendicular direction to lid 201R and is the lower edge of third passageway 214. Opening 219 continues downward from the opening 214U, and is dented for receiving the first coin hopper 100H. Opening 216U is at the lower edge of the fourth passageway 216.

Figure 18:
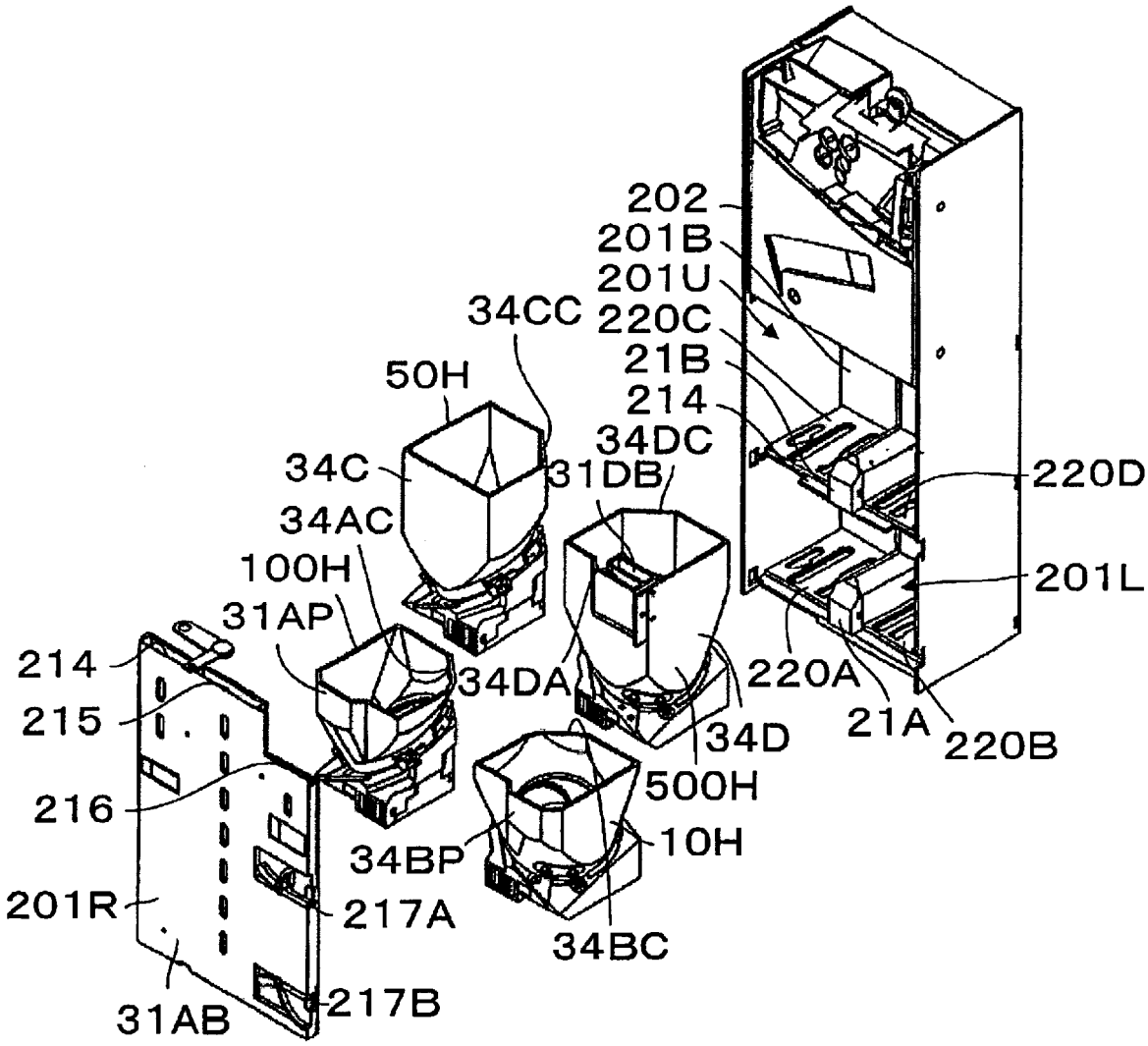
FIG. 18 is an exploded perspective view of the coin mechanical of the second embodiment.

The coin storing section 201S is separated into an upper storing section 201U and under storing section 201L by a middle separating board 214 which is level or horizontal as shown in FIG. 18. The first coin hopper 100H and the second coin hopper 10H are located at the lower storing section 201L and are aligned laterally in the same manner as the first embodiment. The first coin hopper 100H and the second coin hopper 10H can move in or out of the coin storing section 201L by sliding devices 220A and 220B mounted in the frame housing in the same manner as the first embodiment.

The third coin hopper 50H and the fourth coin hopper 500H are located at the upper storing section 201U and are aligned laterally. The third coin hopper 50H can move in or out of the coin storing section 201U by a sliding device 220C the same as the sliding device 220A. The fourth coin hopper 500H can move in or out of the coin storing section 201u by a sliding device 220D the same as the sliding device 220C.

The third coin hopper 50H is the same as the first coin hopper 100H however the shape of the storing bowl 34C is slightly different. The fourth coin hopper 500H is the same as the second coin hopper 10H; however the shape of the storing bowl 34D is slightly different. The third coin hopper 50H is located above the first coin hopper 100H, and the fourth coin hopper 500H is located above the second coin hopper 10H. Accordingly the coin hoppers are aligned lateral and are aligned perpendicularly or vertically; as a result, the space is smaller and more compact.

The upper opening of the storing bowl 34C is located under the 100 Yen receiving passageway 209, and the third coin hopper 50H which dispenses 100 Yen. The upper opening of the storing bowl 34D is located under the 10 Yen receiving passageway 209, and the fourth coin hopper 500H which dispenses 10 Yen. The upper opening of the storing bowl 34A is located under the opening 214U of the third passageway 214 which continues to the 50 Yen receiving passageway 211, and the first coin hopper 100H which dispenses 50 Yen.

The upper opening of the storing bowl 34B is located under the fourth passageway 216 which continues to the 500 Yen receiving passageway 212, and the second-coin hopper 10H dispenses 500 Yen. A guiding passageway 34DA which extends perpendicular and a guiding passageway 34DB are located at the lid 201R side of the storing bowl 34D of the fourth coin hopper 500H. The guiding passageway 34DB extends perpendicular and the lower opening is closed by an arc surface and opens towards the side of the storing bowl 34D, and is located adjacent to the guiding passageway 34DA. Accordingly the 10 Yen coins arrive into the storing bowl 34D and pass through the 10 Yen passageway 208 and the coin passageway 34DB.

The 500 Yen coins arrive into the fourth passageway 216 and pass through the 500 Yen passageway 212 and guiding passageway 34DA. Guiding section 49A is pyramid like in shape which lays down and is structured by the dispensing guide surface 44A of the first coin hopper 100H, dispensing guide surface 44B of the second coin hopper 10H, downwards slanting guide surfaces 48A and 48B and the rear 201RR.

Figure 19:
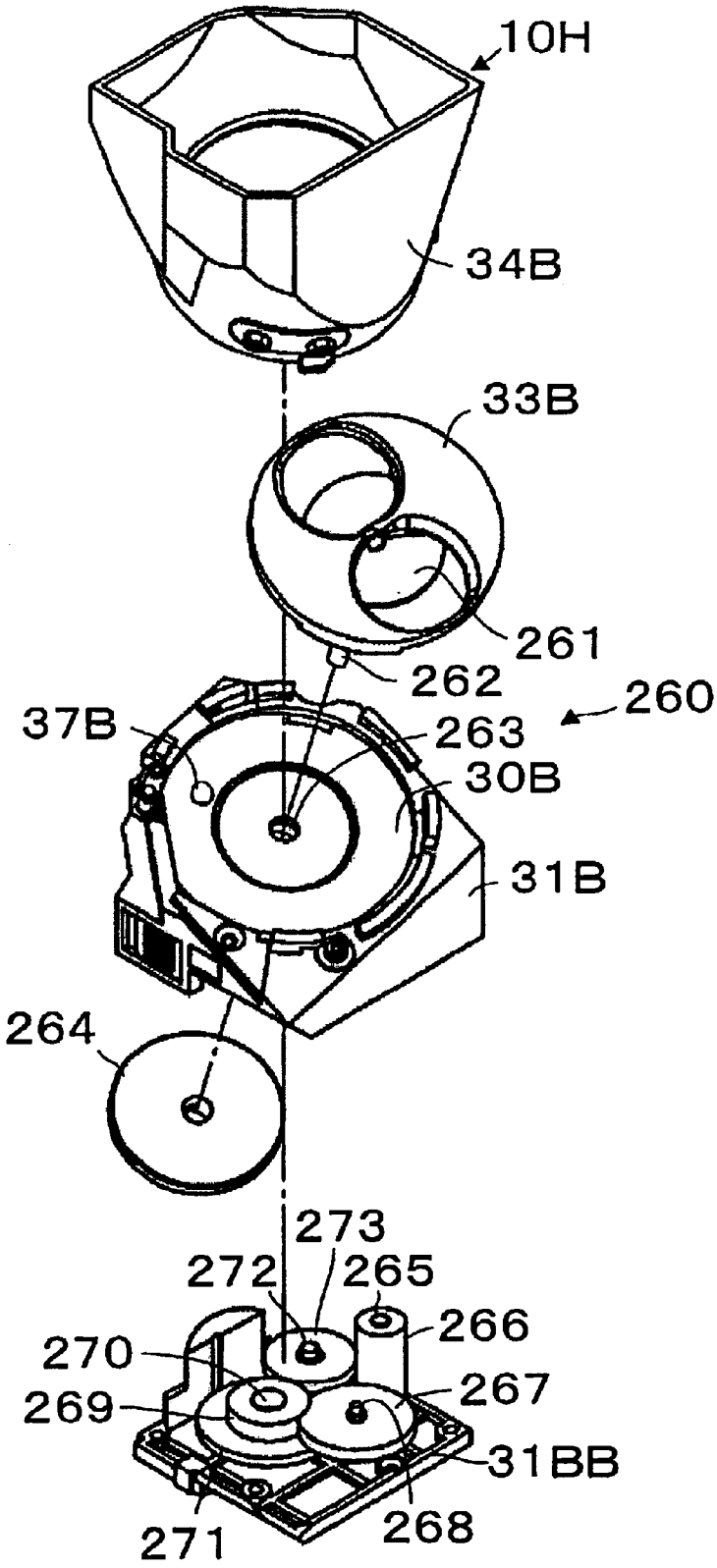
FIG. 19 is an exploded perspective view of the coin hopper of the second embodiment.

Next a transmission device for supplying power to the rotating discs is explained. In the transmission device of the second embodiment, the rotating discs are rotated by only one electrical motor. Firstly, a disc driving device 260 of the coin hopper is explained by referring to the second coin hopper 10H shown in FIG. 19. The rotating disc 33B is fixed at the disk 261 in a coaxial direction. Shaft 262 is fixed at the rear of the disk 261 and penetrates in hole 263 at the center of the hopper base 31B.

Therefore the rotating disc 33B can rotate in shaft 262 on the slanting slide surface 30B relative to a horizontal plane. Screw gear 264 has a spiral shape and is fixed at the lower section of the shaft 262. The screw gear 264 is a second gear which has a slanting rotating shaft the same as the slant of the rotating disc 33B. Spar gear 266 is rotatable on shaft 265 which is fixed at base plate 31BB of the hopper base 31B and is perpendicular. The screw gear 264 engages with the upper section of gear 266.

Gear 267 engages with the lower section of gear 266 which is rotatable on shaft 268 and which is fixed at the base plate 31BB. Gear 269 engages with gear 267 and is rotatable on shaft 270. Gear 271 is unified with gear 269 and engages with gear 273 which rotates on shaft 272. A part of driven gear 273 is exposed at the hopper base 31B. The driven gear 373 is a first gear which has a rotating shaft line parallel to the rotating shaft line of a gear 312A which we will explain later, and it is a driven unit.

The driven unit can alternatively be changed to a friction roller which is a pair of drivers. However, a gear transmission assembly is desirable because a gear transmission can provide a higher transmission of power. In this structure, when the driven gear 273 is driven, the screw gear 264 is rotated through the gears 271, 269, 267 and 266. Therefore the rotating disc 33B is rotated by the rotating shaft 262 and disk 261.

Accordingly, the driving device of the rotating disc 33B becomes simple and inexpensive because the driving force of the gear changes from the level direction to the slanted direction. The driving device of the fourth coin hopper 500H is the same as the driving device 260. The driving devices of the first coin hopper 100H and the third coin hopper 50H are overall the same as the driving device 260 however the gears are located in an opposite position.

Figure 20:
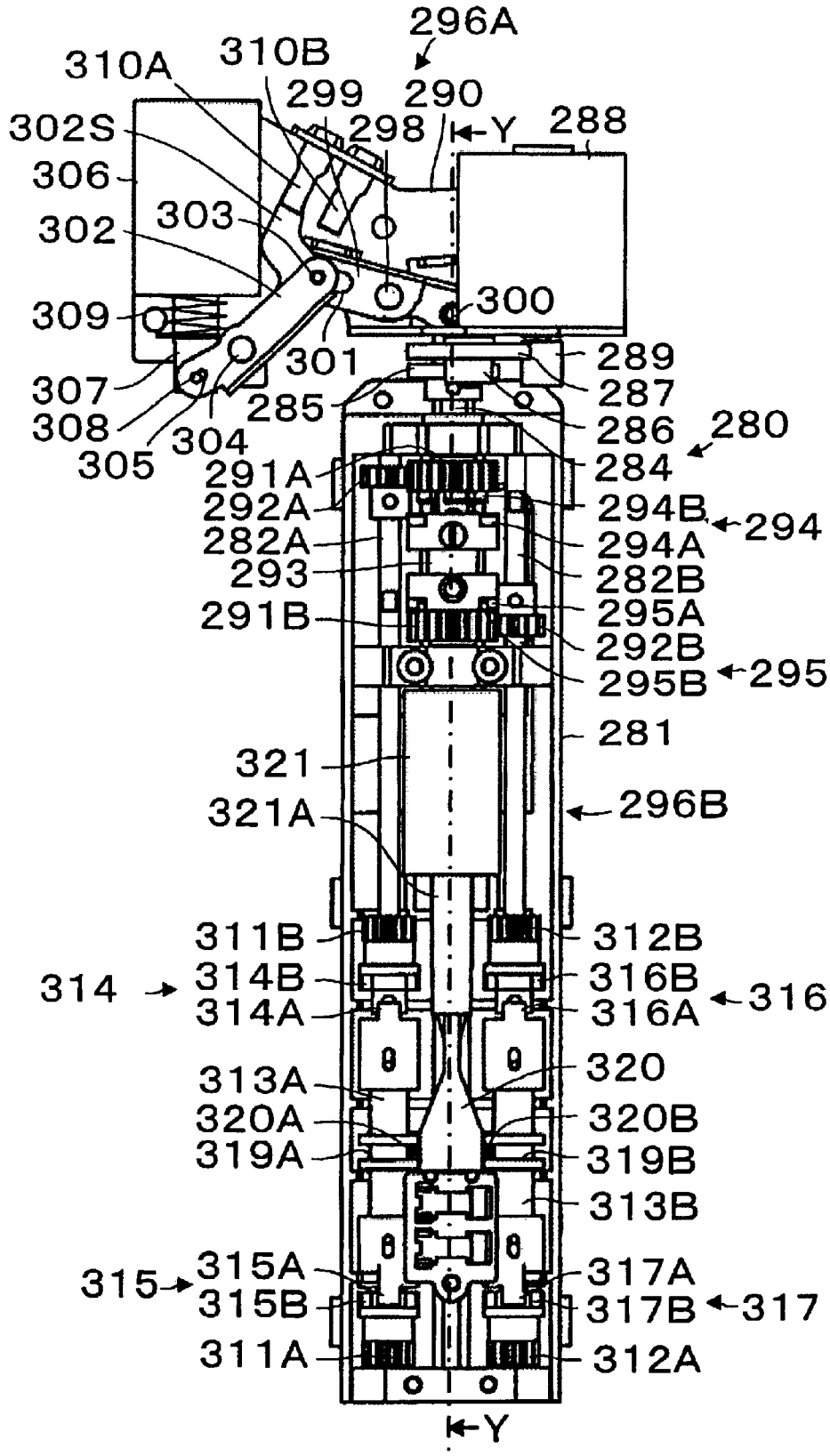
FIG. 20 is a front view of a transmitting device which is used in the coin dispensing device of the second embodiment.
Figure 21:
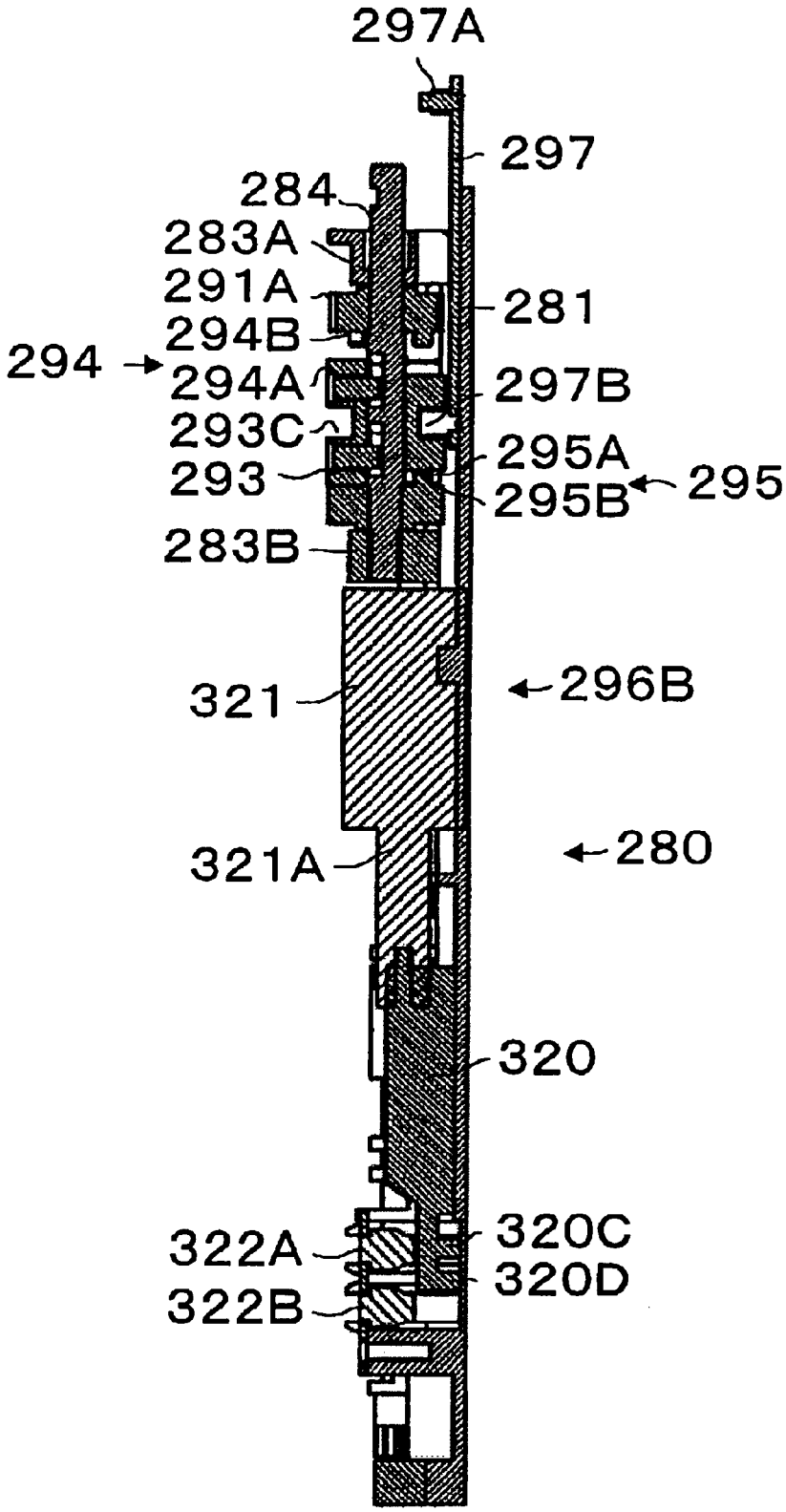
FIG. 21 is a cross section view along the Y—Y line in FIG. 20.
Figure 24:
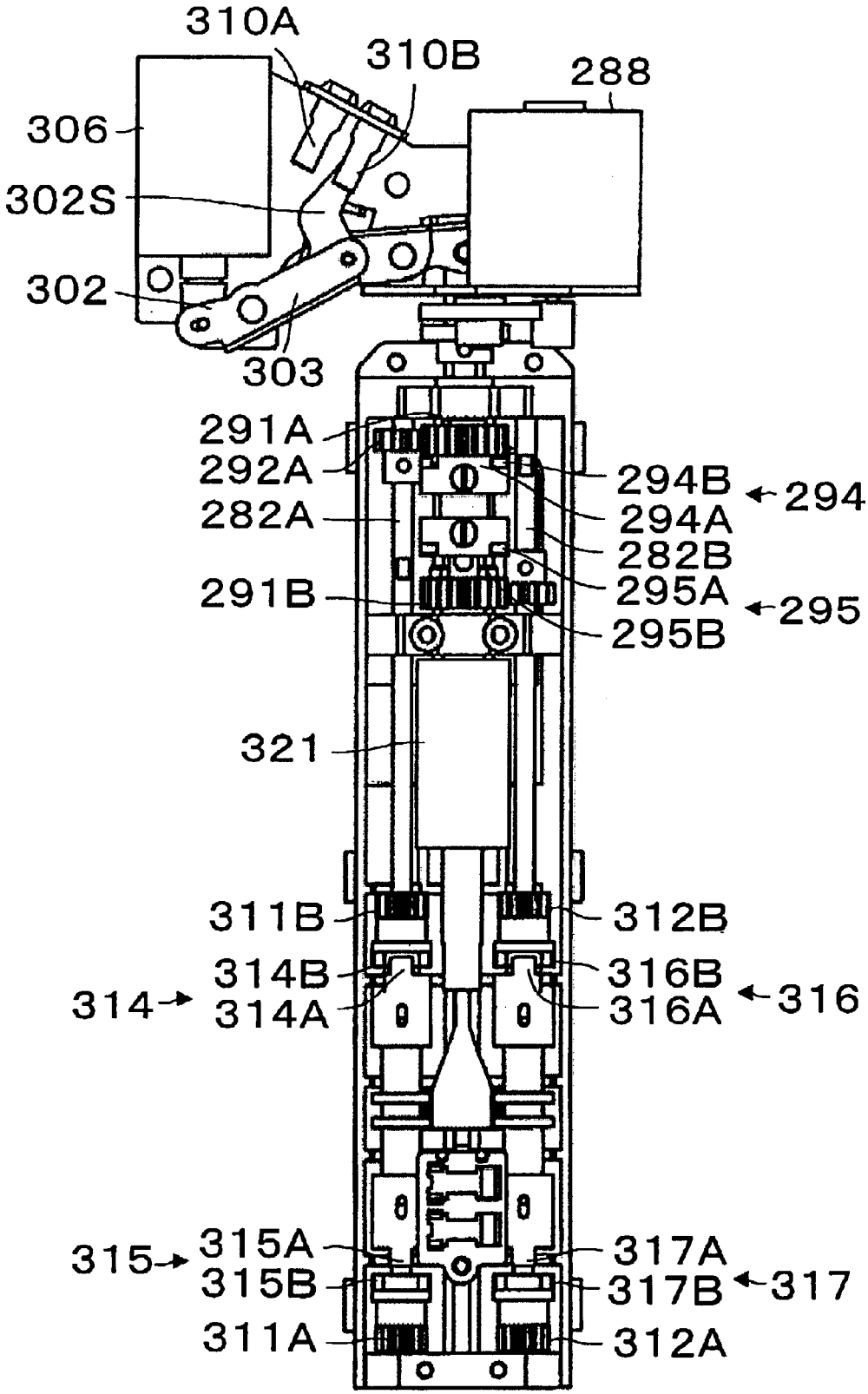

Next selectively driving unit 280 of the coin hoppers is explained by referring to FIG. 20 through to FIG. 24. The selectively driving unit 280 has a function of being selectively rotatable to the specific rotating discs of the first coin hopper through to the fourth coin hopper. Shafts 282A and 282B are attached at frame 281 and are parallel to each other. Driving shaft 284 is located between shaft 282A and shaft 282B and is parallel to the shafts and is further rotatable on the bearings 283A and 283B of frame 281.

Spur gear 285 is fixed at the upper section of the driving shaft 284 and engages with idle gear 286. The idle gear 287 is unified to the idle gear 286 and engages with driving gear 289 which is fixed on the output shaft of a reversible electrical motor 288. The motor 288 is fixed at bracket 290. The idle gears 286 and 287 are rotatable on a shaft (not shown).

Spur gears 291A and 291B are attached on the driving shaft 284 which are spaced away from each other. The spur gear 291A engages with spur gear 292A which is fixed at the upper section of shaft 282A. Spur gear 291B of the lower section of the driving shaft 284 engages with spur gear 292B which is fixed on shaft 282B. Slider 293 is located between spur gears 291A and 291B and in a unified manner is rotatable and is slidable on the driving shaft 284.

Claw 294A is located at the edge of slider 293 and is face to face with the edge of spur gear 291A. Claw 294B is located at the edge of the spur gear 291 and is face to face with the edge of slider 293. First clutch 294 is structured by claws 294A and 294B. Claw 295A is located at the edge of slider 293 and is face to face with the edge of spur gear 291B. Claw 295B is located at the edge of spur gear 291B and is face to face with the edge of slider 293. Second clutch 295 is structured by claws 295A and 295B.

Next, a first changing device 296A of the clutch is explained. The first changing device 296A has a function that permits a selectively reversible rotation to either shafts 282A or 282B to address any jamming of coins. Rod 297 can slide in the perpendicular direction and is located between driving shaft 284 and frame 281. Pin 297B is fixed at the lower end of rod 297 and is inserted into groove 293C of slider 293. Pin 297A is fixed at the upper section of rod 297 and is inserted into hole 300 at the edge of lever 299 which can pivot on shaft 298.

Pin 303 is fixed at the edge of lever 302 and is slidable and is further inserted into elongated hole 301 at the other end of lever 299. Lever 302 pivots on shaft 304 which is fixed at bracket 290. Pin 308 is fixed at armature 307 of a first solenoid 306 and is slidable and is inserted into elongated hole 305 at the other end of the lever 302. The first solenoid 306 is fixed at bracket 290. The armature 307 is usually moved by spring 309.

When first solenoid 306 is not excited, armature 307 is located at the lower position as shown in FIG. 20. Accordingly lever 302 pivots in the counter clockwise direction through pin 308 and elongated hole 305. Also, lever 299 pivots in the clockwise direction through pin 303 and elongated hole 301. Therefore slider 293 moves to the lowest position through hole 300, pin 297A, rod 297 and pin 297B, and second clutch 295 which are all operatively connected. As a result, shaft 282B is rotated through slider 293, clutch 295, spur gears 291B and 292B by driving shaft 284.

When the first solenoid 306 is excited, armature 307 is drawn upwards. Therefore slider 293 lifts up, and first clutch 294 is connected. Shaft 282A is rotated by driving shaft 284 through slider 293, clutch 294, spur gears 291A and 292A. Changing position sensor 310A detects piece 302S of lever 302. Therefore it detects a connecting situation of the second clutch 295 indirectly.

Changing position sensor 310B detects piece 302S of lever 302. Therefore it detects a connecting situation of the first clutch 294 indirectly. This structure is a selecting device which can select the hoppers which are either positioned left or right.

Next the driving device of the coin hoppers which are located at a perpendicular or vertically aligned direction is explained. First spur gear 311A is rotatable at the lower section of the shaft 282A. Third spur gear 311B is rotatable on shaft 282A and is located between first spur gear 311A and spur gear 292A.

The first spur gear 311A and the third spur gear 311B cannot slide along shaft 282A. Also the second spur gear 312A is rotatable and is attached at the lower section of shaft 282B. Fourth spur gear 312B is rotatable and is located between second spur gear 312A and spur gear 292B. The second spur gear 312A and the fourth spur gear 312B cannot slide along shaft 282B. The first spur gear 311A, the second spur gear 312A, the third spur gear 311B and the fourth spur gear 312B are driving gears which are fixed at the frame 1F.

Slider 313A is supported on shaft 282A and is located between first spur gear 311A and third spur gear 311B and cannot rotate to shaft 282A and can slide along shaft 282A. Clutch piece 314A is located at the edge of third spur gear 311B side and of slider 313A. Clutch piece 314B is located at the edge of the third spur gear 311B. The clutch pieces 314A and 314B form a structure or a third clutch 314.

Clutch piece 315A is located at the edge of the first spur gear 311A side of the slider 313A. Another clutch piece 315B is located at the edge of the first spur gear 311A. Clutch pieces 315A and 315B form a structure a fourth clutch 315.

The slider 313B is supported on shaft 282B and is located between the second spur gears 312A and 312B and cannot rotate to shaft 282A and can slide along shaft 282B. Clutch piece 316A is located at the end of the fourth spur gear 312B side of the slider 313B. Another clutch piece 316B is located at the fourth spur gear 312B. The clutch pieces 316A and 316B form a structure of a fifth clutch 316.

Clutch piece 317A is located at the edge of the slider 313B and is face to face with the second spur gear 312A. Another clutch piece 317B is located at the edge of the second spur gear 312A. The clutch pieces 317A and 317B form a structure of a sixth clutch 317.

Next a second changing device 296B is explained. The second changing device 296B has a function that selectively connects between the third clutch 314 and the fifth clutch 316 or between the fourth clutch 315 and the sixth clutch 317. Pins 320A and 320B protrude from slider 320 and are inserted into groove 319A of the slider 313A and groove 319B of the slider 313B.

Slider 320 is connected with armature 321A of the second solenoid 321 which is fixed at frame 281 and is located in the space which is enclosed by the driving shaft 284, the third spur gears 311B and 312B and is located between shafts 282A and 282B. The solenoid 321 has a function that permits the changing position of the armature 321A.

For example, the fourth clutch 315 and the sixth clutch 317 are connected when the second solenoid 321 is excited and the armature 321A is pulled upwards. Therefore slider 320 is pulled upwards, and the third clutch 314 and fifth clutch 316 are connected. Next when the second solenoid 321 is excited, the fourth clutch 315 and the sixth clutch 317 are connected.

The third position sensor 322A detects piece 320C of slider 320, and detects the connection between third clutch 314 and fifth clutch 316 indirectly. The fourth position sensor 322B detects piece 320D of the slider 320, and detects the connection between the fourth clutch 315 and the sixth clutch 317 indirectly.

Accordingly when the second clutch 295, the fourth clutch 315 and the sixth clutch 317 are connected as shown in FIG. 20, the second spur gear 312A is rotated, because shaft 282B is rotated by the motor 288.

Figure 22:
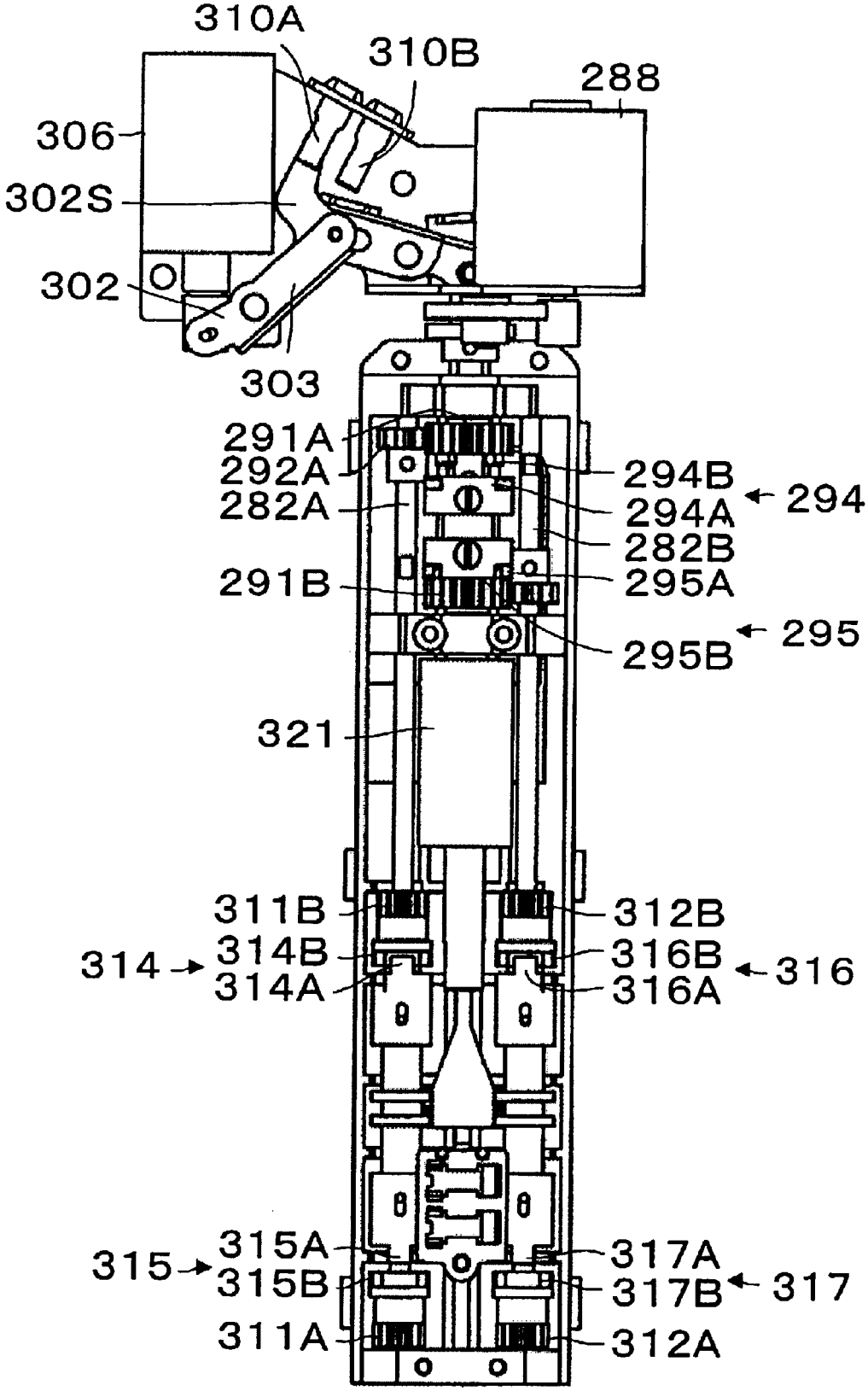
FIG. 22 through to FIG. 24 are operation views for explaining the control of the second embodiment.
Figure 23:
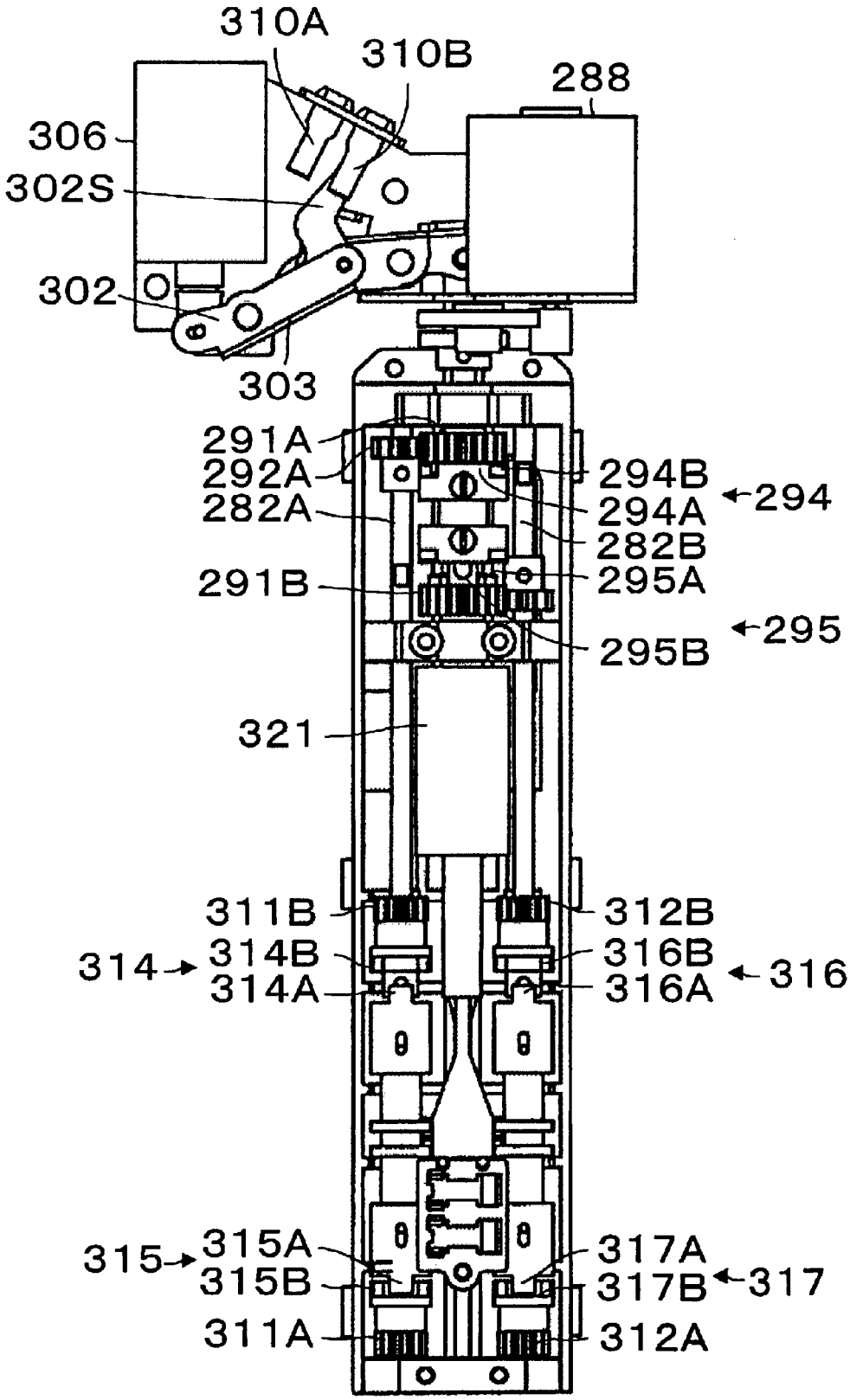

In this situation, when the second solenoid 321 is excited, the second clutch 295, the third clutch 314 and the fifth clutch 316 are connected. Accordingly fourth spur gear 312B is rotated as shown in FIG. 22. When the first solenoid 306 is excited and the second solenoid 321 is re-excited, first clutch 294, fourth clutch 315 and sixth clutch 317 are connected. Therefore spur gear 311A is rotated as shown in FIG. 23.

When the first solenoid 306 is excited and the second solenoid 321 is re-excited, first clutch 294, third clutch 314 and fifth clutch 316 are connected. Accordingly the third spur gear 311B is rotated as shown in FIG. 24. Also, when the rotating discs are rotated in the reverse direction, motor 288 rotates in the reverse direction. The driving device is structured by the mechanical clutches and is relatively inexpensive and easy to maintain. However, the mechanical clutches could be changed to electric clutches in an alternative configuration.

In the selectively driving device 280, the cover covers shafts 282A, 282B and clutches, and the exterior of the cover has a triangular prism shape. Shafts 282A and 282B are perpendicular and are attached to the back wall 210B of frame 201F. Therefore, it is located at the triangular section 201A which is located between the first coin hopper 100H and the second coin hopper 10H, and between the third coin hopper 50H and the fourth coin hopper 500H (as shown in FIG. 3).

The storing hoppers of the coin hoppers have specific alignment chamfers 34AC, 34BC, 34CC and 34DC to secure the locating section of the selectively driving device 280. The first changing device 296A is located between the coin selector 202 and the rear wall 201B. The first spur gear 311A and the second spur gear 312A are exposed at the lower storing section 201L. The third spur gear 311B and the fourth spur gear 312B are exposed at the upper storing section 201U.

When the first coin hopper 100H is contained in the lower storing section 201L, the spur gear 273 has contact with the spur gear 311A. When the second coin hopper 10H is contained in the lower storing section 201L, the spur gear 273 has contact with the spur gear 312A. When the third coin hopper 50H and the fourth coin hopper 500H are contained in the upper storing section 201U, the spur gear 273 has contact with each of the spur gears 311B and 312B. The third coin hopper 50H has a third empty sensor 47C and a third full sensor 46C, and the fourth coin hopper 500H has a fourth empty sensor 47D and a fourth full sensor 46D. Thus a removable drive connection is provided that permits the coin hoppers to be slid out of the housing for recharging of coins.

Next a control block diagram of the second embodiment is explained referring to FIG. 25. A microprocessor 250 receives the dispensing signals P50, P100, P50 and P10 of each denomination from the control device of the vending machine, the first dispensing sensor 45A, the second dispensing sensor 45B, the first full sensor 46A, the second full sensor 46B, the third full sensor 46C, the fourth full sensor 46D, first empty sensor 47A, the second empty sensor 47B, the third empty sensor 47C and the fourth empty sensor 47D. The microprocessor 250 can selectively drive motor 385, first solenoid 306 and second solenoid 321, also it can output a dispensing finished signal PF and a predetermined signal to the display or the printer based on the program. The coin hoppers 500H, 100H, 50H and 10H can dispense coins as indicated by the number of coins in the same manner as the first embodiment.

Figure 26:
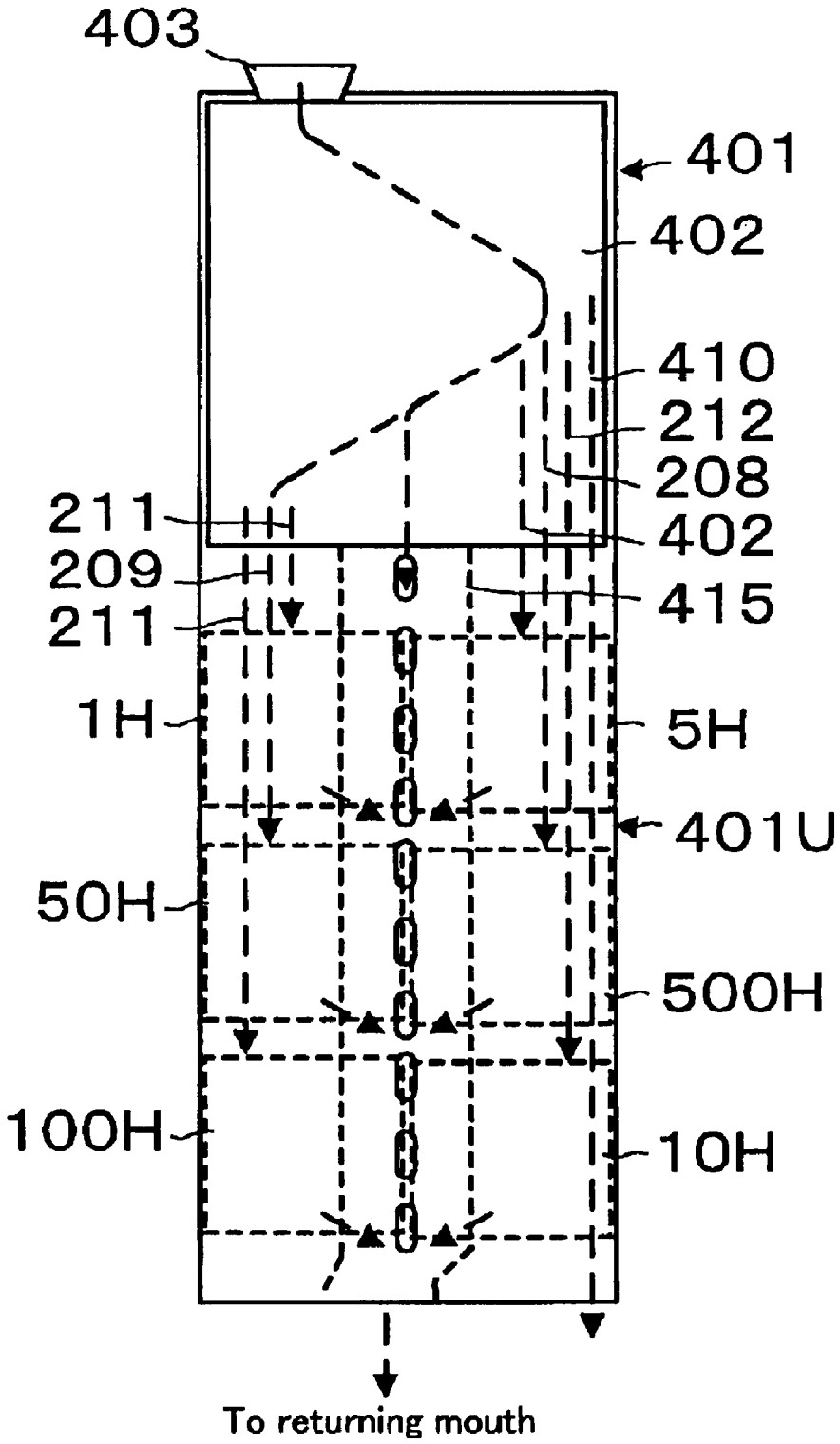
FIG. 26 is a schematic front view of the coin mechanical with the coin dispensing device of the third embodiment.

Next, a third embodiment has six coin hoppers and is explained by referring to FIG. 26. The third embodiment adds a 5 Yen hopper and a 1 Yen hopper to the second embodiment. Fifth coin hopper 1H stores 1 Yen coins and is located over the third coin hopper 50H in the coin storing section 401U. Sixth coin hopper 5H stores 5 Yen coins and is located over the fourth coin hopper 500H in the coin storing section 401U. Accordingly the first coin hopper 100H, the third coin hopper 50H and the fifth coin hopper 1H are aligned in the perpendicular direction. Accordingly the second coin hopper 10H, the fourth coin hopper 500H and the sixth coin hopper 5H are aligned in the perpendicular or vertical direction.

The rotating discs of the hoppers can be designed to be selectively driven by individual motors or can be selectively driven by a single motor and multi-clutches in the same manner as the second embodiment.

The coins received by coin selector 402 are diverted to each passageway and are guided to corresponding coin hoppers. The coins are dispensed by the coin hoppers into a common dispensing passageway 415 which is located in the middle of the hopper's alignment and are guided to the dispensing mouth. In the third embodiment, the coins are selectively dispensed the same as in the second embodiment.

Those skilled in the art will appreciate that various adaptations and modifications of the just-described embodiments can be configured without departing from the scope and spirit of the invention. Therefore, it is to be understood that, within the scope of the appended claims, the invention.

What is claimed is:

1. A coin dispensing device comprising:

at least a pair of coin hoppers, a coin dispensing unit in each coin hopper for dispensing a coin through an aperture; and a dispensing passageway that is operatively connected with each coin dispensing unit aperture to provide a common passageway for dispensed coins, the pair of coin hoppers are aligned in a lateral direction to provide a compact configuration with the respective aperture dispensing coins into the common passageway.

2. The coin dispensing device of claim 1 further including a third coin hopper with a coin dispensing unit for dispensing a coin through an aperture, the third coin hopper is aligned vertically above one of the pair of coin hoppers and is operatively connected with the common passageway.

3. The coin dispensing device of claim 1 further including a single drive member for selectively activating the coin dispensing units.

4. The coin dispensing device of claim 1 wherein each coin dispensing unit includes a rotating disc for contacting and dispensing a coin from a coin hopper, the rotating discs have a surface that forms an angle to a rotational axis of the rotating disc.

5. The coin dispensing device of claim 1 further including a housing member and a pair of mounting assemblies connected to the housing member, each mounting assembly is respectively connected to one of the pair of coin hoppers and enables a relative movement of the coin hopper out of the housing member to facilitate charging a coin hopper with coins.

6. The coin dispensing device of claim 5 wherein at least one mounting assembly permits a relative sliding and pivoting movement of a coin hopper from the housing member.

7. The coin dispensing device of claim 5 further including a single drive member for operatively connecting with the coin hoppers when moved into the housing member.

8. The coin dispensing device of claim 7 further including a transmission assembly for selectively engaging the single drive member with the coin hoppers when the mounting assemblies enable an operative movement of the coin hoppers into the housing member.

9. The coin dispensing device of claim 8 further including a closure member for connection with the housing member to secure the coin hoppers within the housing member, the closure member forming a portion of the dispensing passageway.

10. The coin dispensing device of claim 1 wherein the first coin hopper is driven by a first motor and the second coin hopper is driven by a second motor.

11. A coin dispensing device comprising:

a housing member;

a first coin hopper mounted in the housing member for a coin of a first denomination;

a second coin hopper mounted in the housing member for a coin of a second denomination, the second coin hopper is aligned below the first coin hopper; and a dispensing passageway operatively connected to the first and second coin hopper for dispensing coins of both a first denomination and a second denomination and movable from the first and second hoppers to provide access.

12. The coin dispensing device of claim 11 further including a third coin hopper mounted in the housing member, and a fourth coin hopper mounted in the housing member, the fourth coin hopper is aligned below the third coin hopper and is positioned alongside of the second coin hopper.

13. The coin dispensing device of claim 11 further including a movable cover member operatively connected to the housing member, the cover member supporting a portion of the dispensing passageway.

14. The coin dispensing device of claim 11 further including a first mounting member connected to the housing member for permitting relative movement of the first coin hopper out of the housing member and a second mounting member connected to the housing member for permitting relative movement of the second coin hopper out of the housing member.

15. The coin dispensing device of claim 14 wherein the first mounting member and second mounting member provide a relative sliding and pivoting movement of the respective first coin hopper and second coin hopper to the housing member.

16. The coin dispensing device of claim 11 further including a first coin dispensing unit with a rotary disc in the first coin hopper and a second coin dispensing unit with a rotary disc in the second coin hopper, a transmission power assembly for removably supplying a rotation force to the first and second coin dispensing units and a first mounting member connected to the housing member for permitting relative movement of the first coin hopper out of the housing member and a second mounting member connected to the housing member for permitting relative movement of the second coin hopper out of the housing member.

17. The coin dispensing device of claim 11 further including a third coin hopper under the second coin hopper, a fourth coin hopper adjacent a side of the first coin hopper, a fifth coin hopper under the fourth coin hopper and a sixth coin hopper under the fifth coin hopper, each coin hopper dispensing a different denomination of coin and aligned in a compact stack in a vertical direction.

18. A coin dispensing device for mounting within a machine that requires dispensing coins of more than one denomination to a user, comprising:

a plurality of coin hoppers, each coin hopper having a rotary disc and structured to store coins in bulk and dispense a different denomination of coin;

a housing frame for mounting the plurality of coin hoppers including a mounting member for each coin hopper that permits a sliding movement of each coin hopper out of the housing frame for servicing the respective coin hopper, wherein at least two of the plurality of coin hoppers are stacked in the housing frame in vertical alignment to conserve space; and a single driving assembly to selectively drive each rotary disc.

19. The coin dispensing device of claim 18 wherein at least four coin hoppers are stacked in the housing frame.

20. The coin dispensing device of claim 19 further including a cover member connected to the housing frame, the cover member providing a common passageway for each coin hopper to dispense coins.

* * * * *